US007594523B2

(12) United States Patent
Koussaifi

(10) Patent No.: US 7,594,523 B2
(45) Date of Patent: Sep. 29, 2009

(54) MACHINE FOR CONTINUOUSLY MANUFACTURING A WELDED METAL TRELLIS

(76) Inventor: Ghattas Youssef Koussaifi, Amchit Main Street, Ghattas Koussaifi Bldg., Amchit (LB)

( * ) Notice: Subject to any disclaimer, the term of this patent is extended or adjusted under 35 U.S.C. 154(b) by 299 days.

(21) Appl. No.: 10/581,608

(22) PCT Filed: Dec. 10, 2003

(86) PCT No.: PCT/FR03/03667

§ 371 (c)(1),
(2), (4) Date: Oct. 3, 2006

(87) PCT Pub. No.: WO2005/065863

PCT Pub. Date: Jul. 21, 2005

(65) Prior Publication Data

US 2007/0057016 A1 Mar. 15, 2007

(51) Int. Cl.
*B21F 15/08* (2006.01)

(52) U.S. Cl. ..... 140/112; 140/3 R; 140/7; 140/17

(58) Field of Classification Search ..... 140/92.1, 140/71 C, 4, 7, 17, 111, 112, 139, 140, 3 R, 140/6, 9, 107; 72/16.1, 16.2, 17.3, 18.1, 72/66, 129, 135, 137, 138, 139
See application file for complete search history.

(56) References Cited

U.S. PATENT DOCUMENTS

| | | | | |
|---|---|---|---|---|
| 2,684,087 A | | 7/1954 | Stockton | |
| 3,651,834 A | * | 3/1972 | Larkin | 140/3 R |
| 4,066,202 A | * | 1/1978 | Binard | 228/173.5 |
| 4,372,350 A | * | 2/1983 | Schmidt et al. | 140/112 |
| 4,478,260 A | * | 10/1984 | Eichler | 140/92.1 |
| 4,605,046 A | * | 8/1986 | Decoux | 140/112 |
| 4,911,209 A | * | 3/1990 | Smith et al. | 140/112 |
| 6,148,873 A | * | 11/2000 | Mehre | 140/112 |
| 7,100,642 B2 | * | 9/2006 | Taboga | 140/7 |

FOREIGN PATENT DOCUMENTS

| | | |
|---|---|---|
| DE | 1 029 788 B | 5/1958 |
| FR | 2 822 736 A | 10/2002 |

* cited by examiner

*Primary Examiner*—Edward Tolan
(74) *Attorney, Agent, or Firm*—Oliff & Berridge, PLC

(57) ABSTRACT

The invention relates to a machine for the production of a continuous strip of wire mesh (100) using a single flexible metal wire (20) which is fed to the machine continuously. According to the invention, the mesh (100) is formed by repeating the same pattern with the metal wire in one plane, each pattern being stacked on the preceding pattern with a constant pitch offset in the axial direction of production. The inventive machine comprises: a metal wire storage stage; a stage for continuously supplying metal wire to the machine; a forming stage for shaping the wire into a succession of identical patterns; a transfer stage for successively moving said metal wire patterns to the mesh-forming plane; a stage for maintaining each pattern in one plane and for offsetting same by a constant pitch with the arrival of the following pattern; and a stage for fixing the patterns to one another. The invention also relates to the strip of mesh (100) thus formed and to the production method thereof.

53 Claims, 32 Drawing Sheets

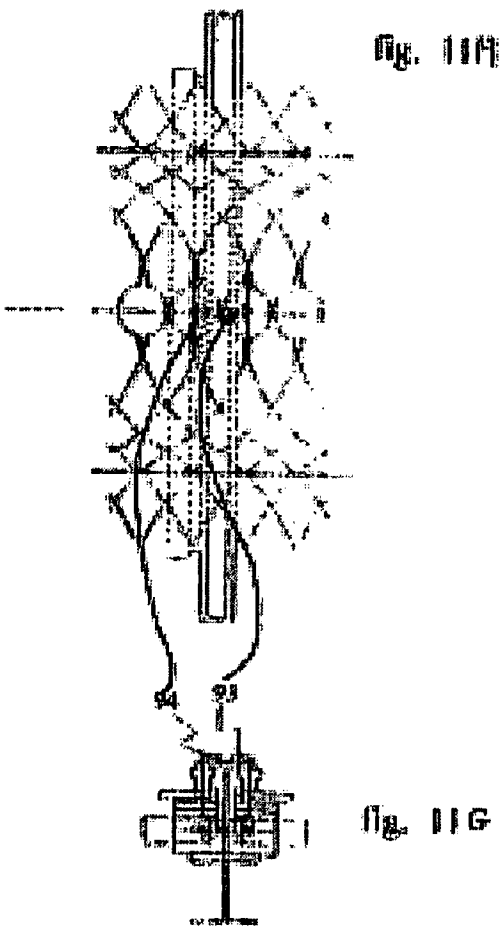
fig. 11H
fig. 11G
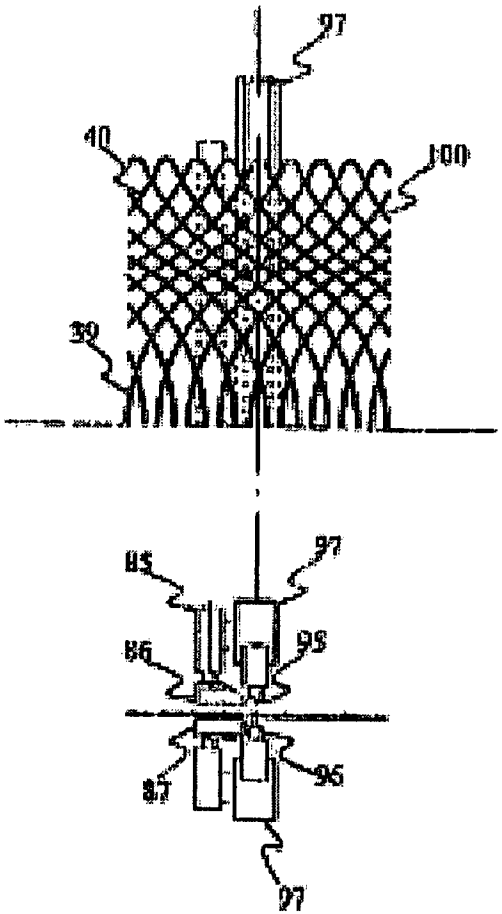
fig. 11F
fig. 11E

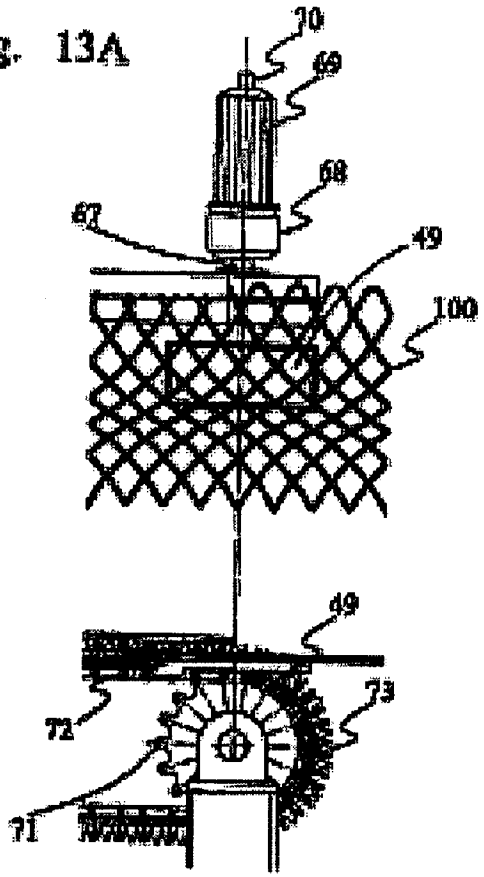
fig. 13A
fig. 13B
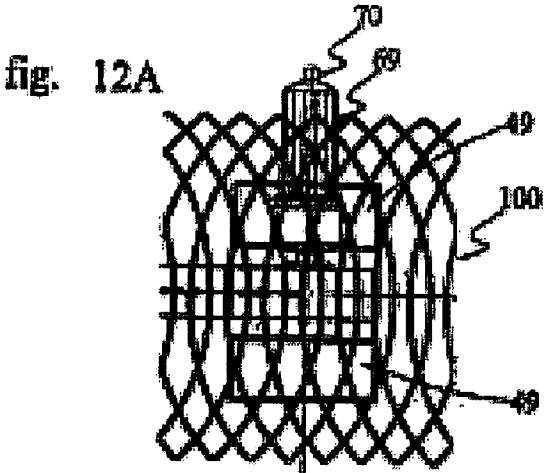
fig. 12A
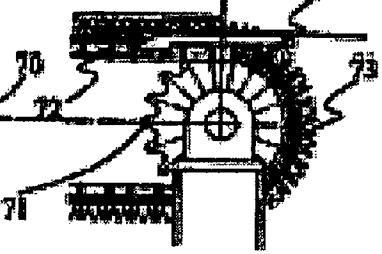
fig. 12B
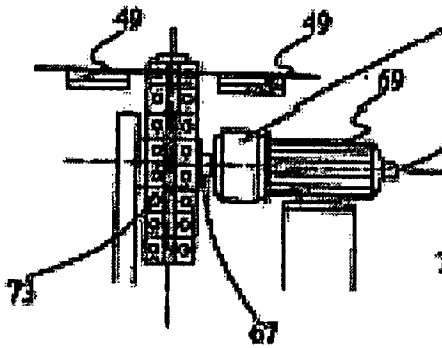
fig. 12C

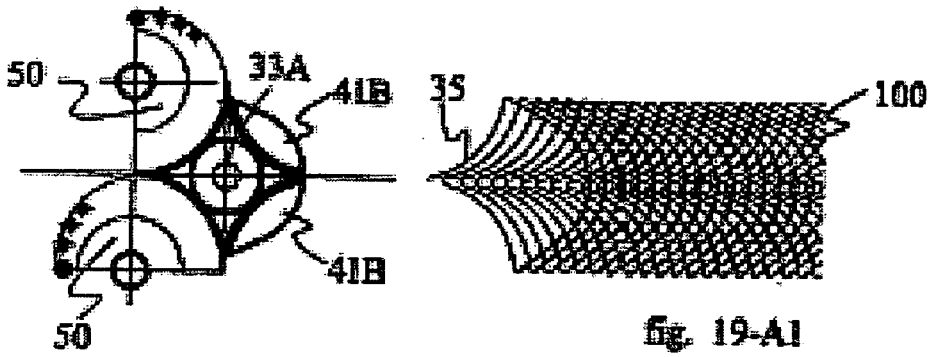
fig. 19-A1
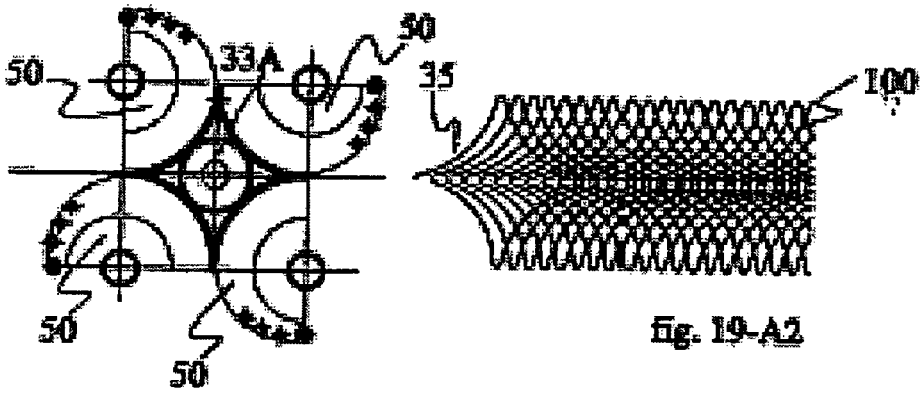
fig. 19-A2
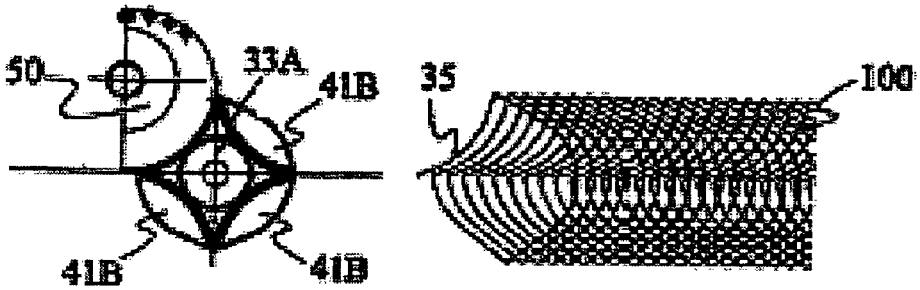
fig. 19-A3
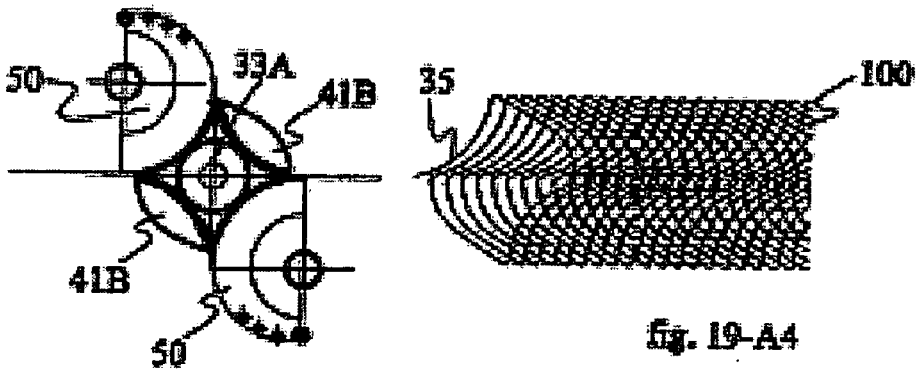
fig. 19-A4

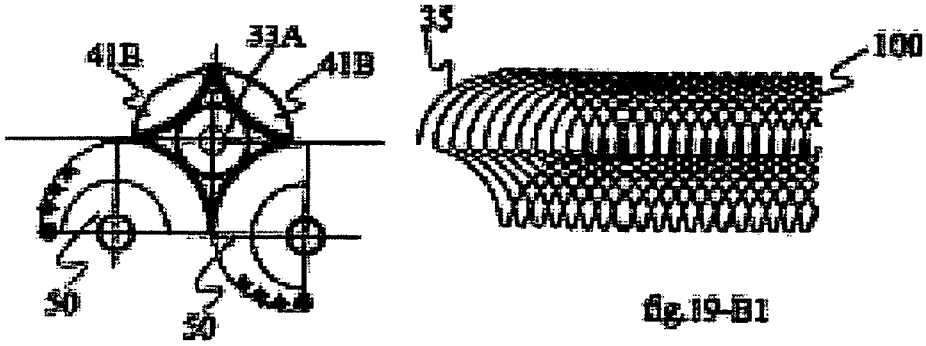
fig.19-B1
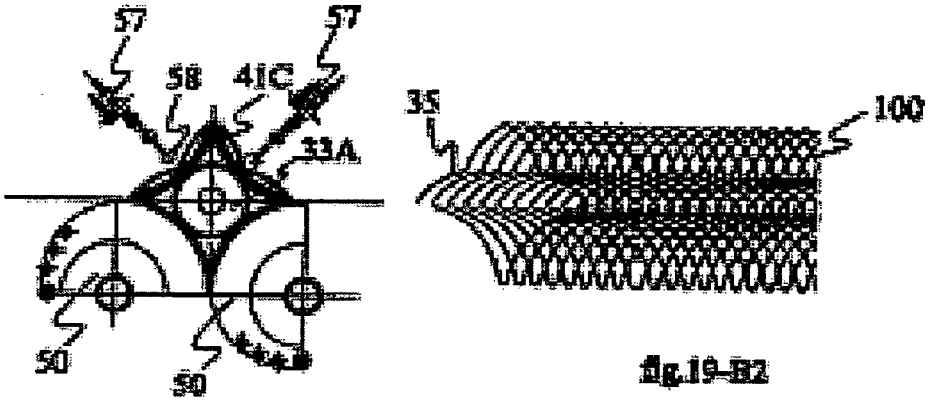
fig.19-B2
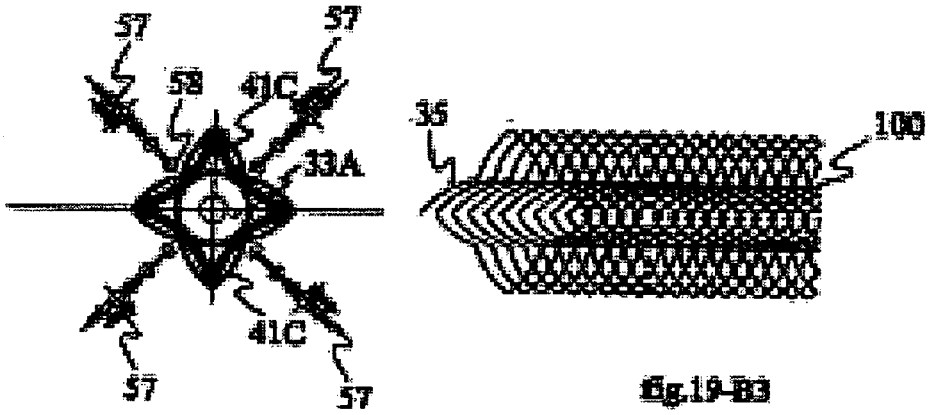
fig.19-B3
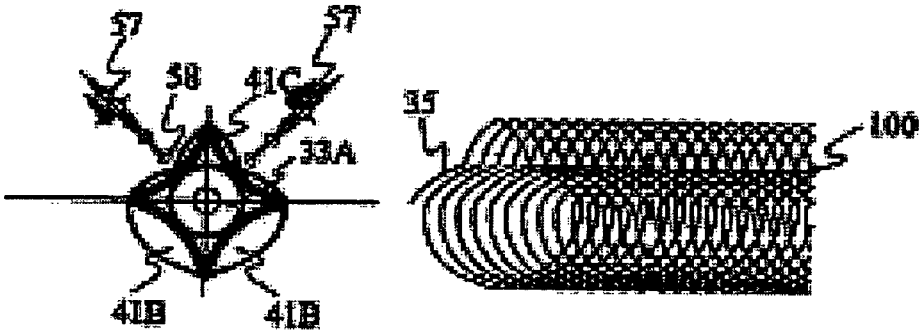
fig.19-B4

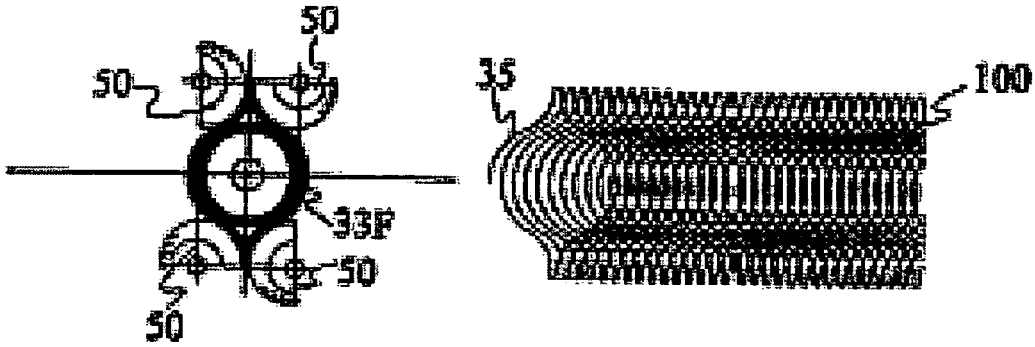
fig.19-C1
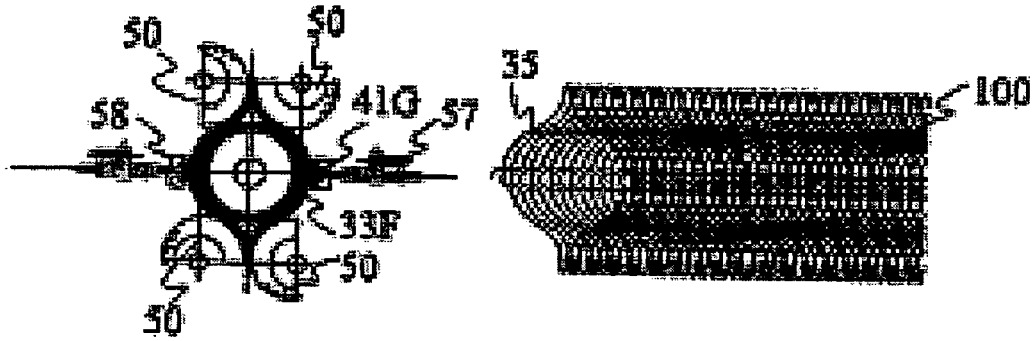
fig.19-C2
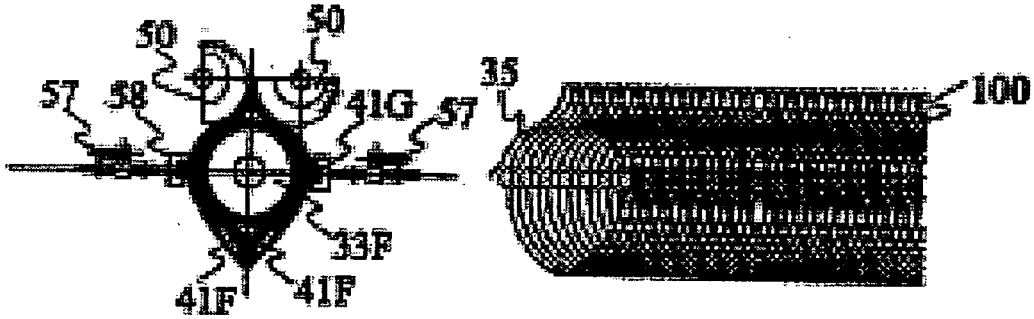
fig.19-C3
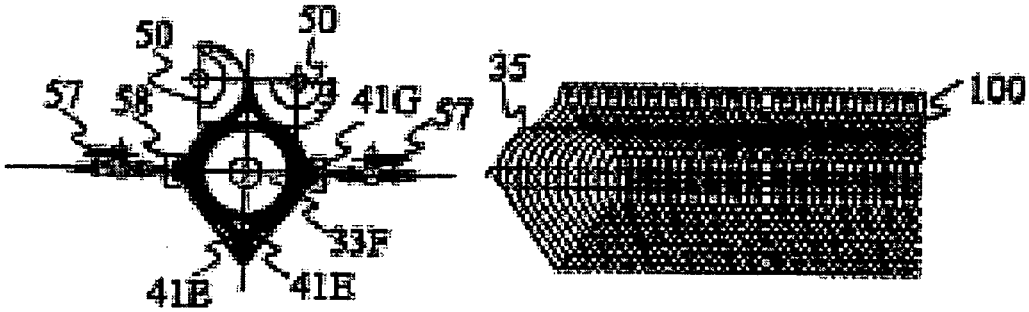
fig.19-C4

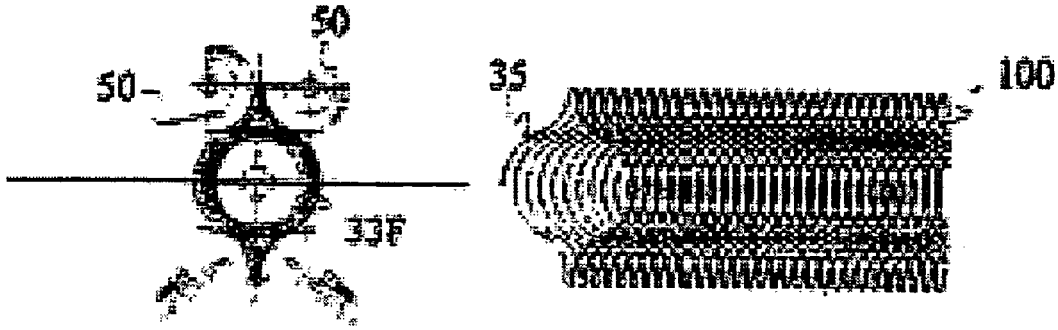
fig.19-C5
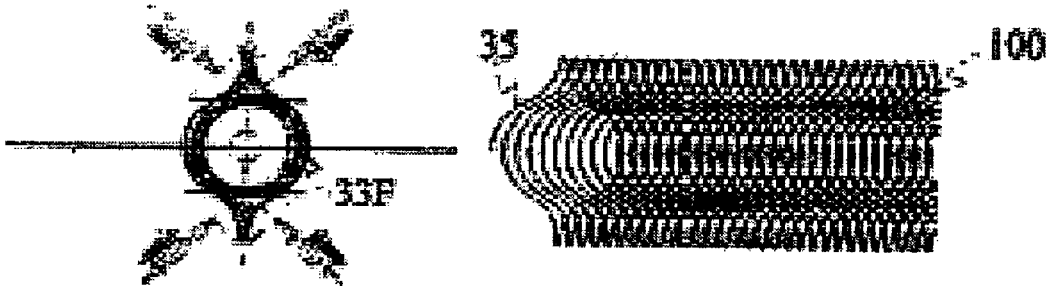
fig.19-C6
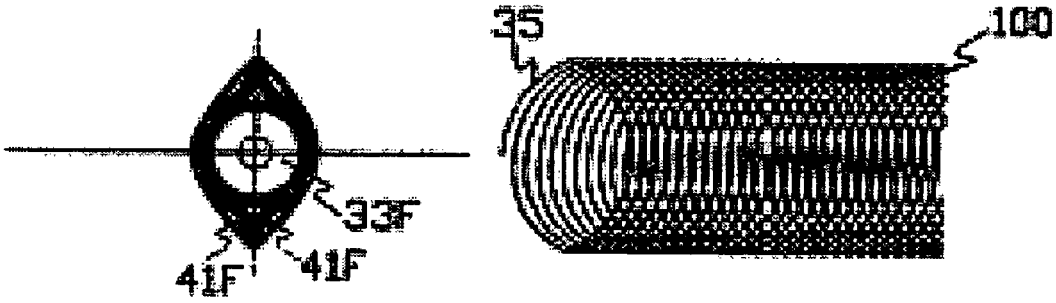
fig.19-C7

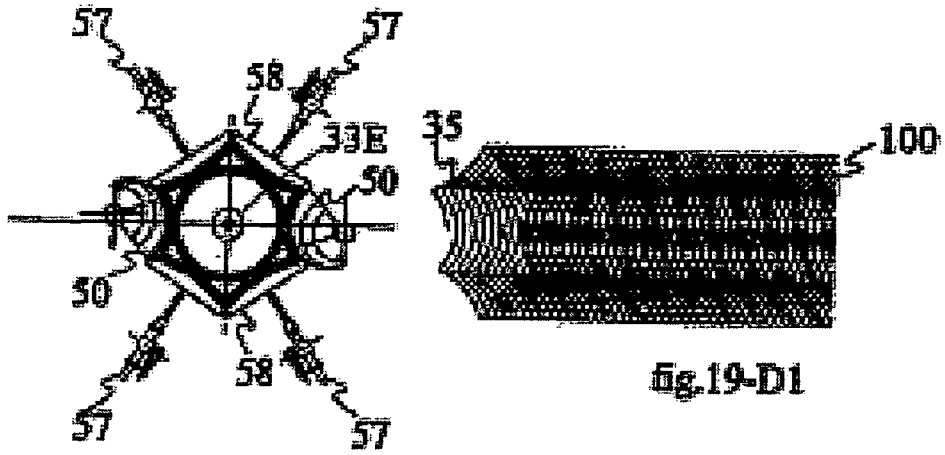
fig.19-D1
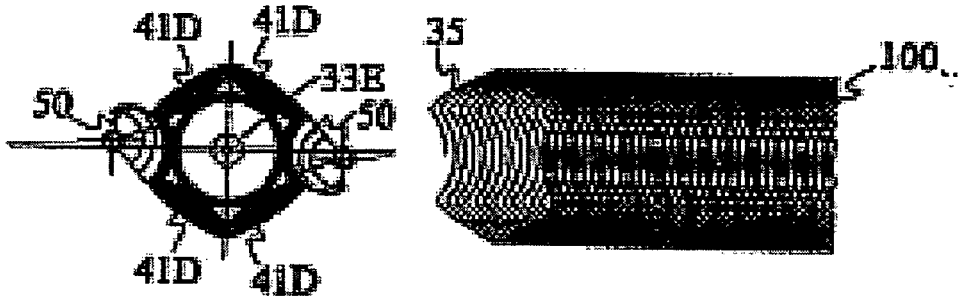
fig.19-D2
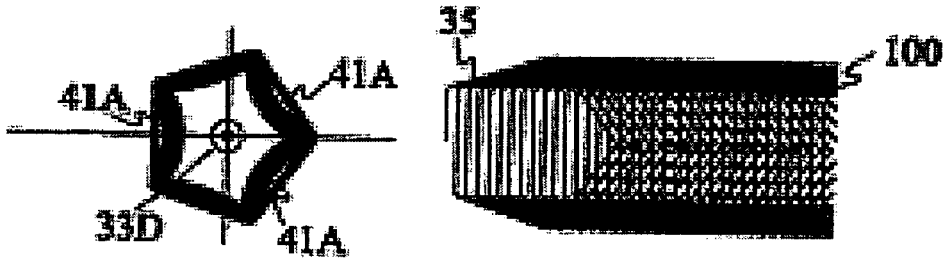
fig.19-D3
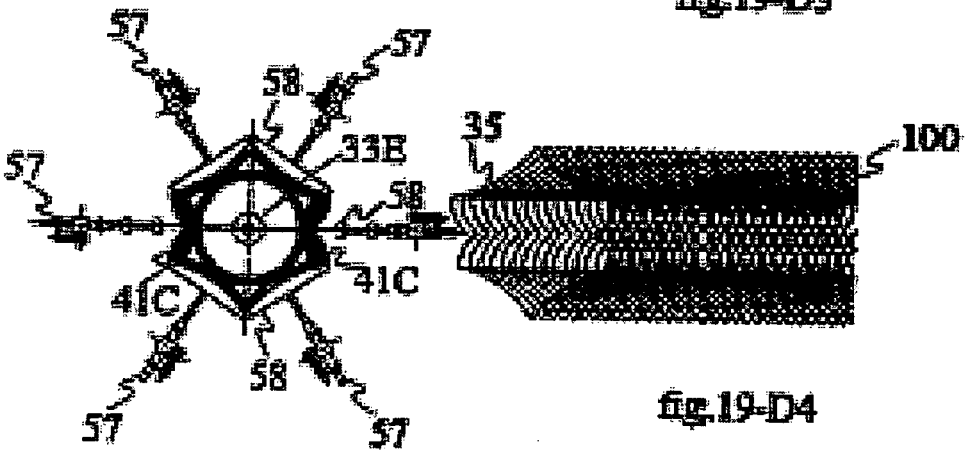
fig.19-D4

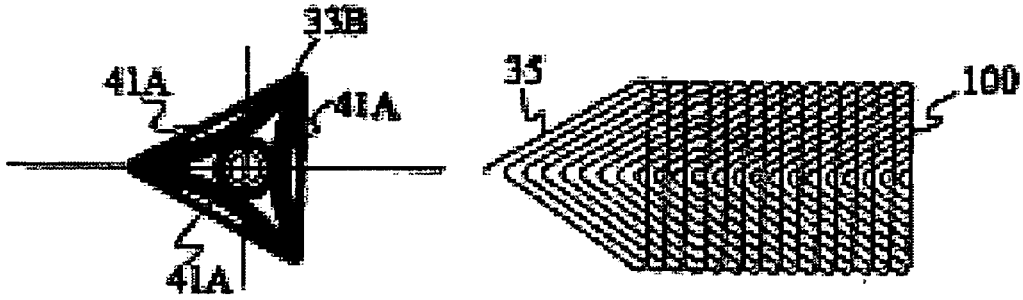
fig.19-E1
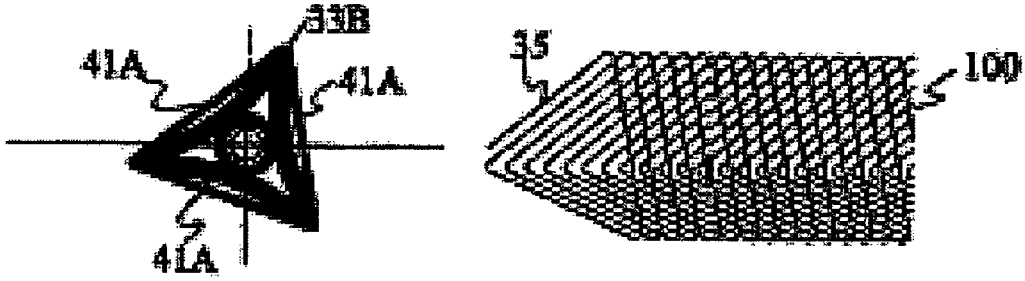
fig.19-E2
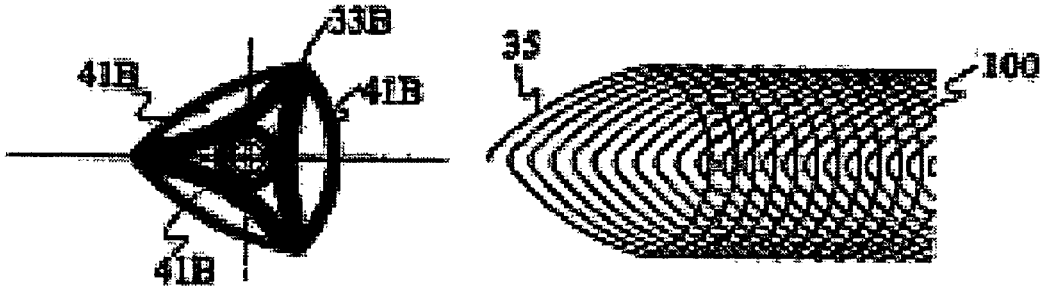
fig.19-E3
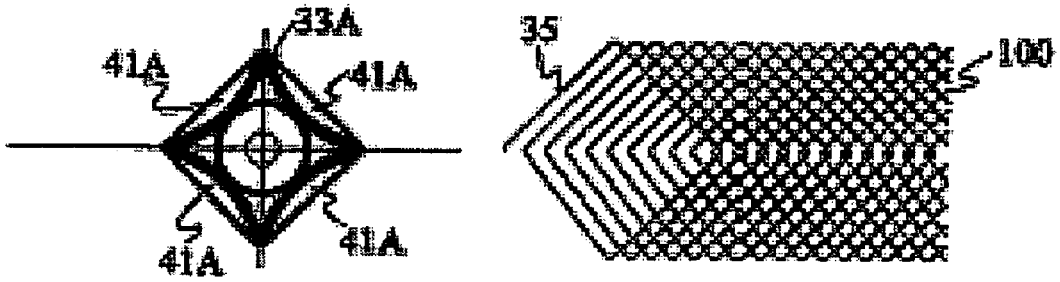
fig.19-E4

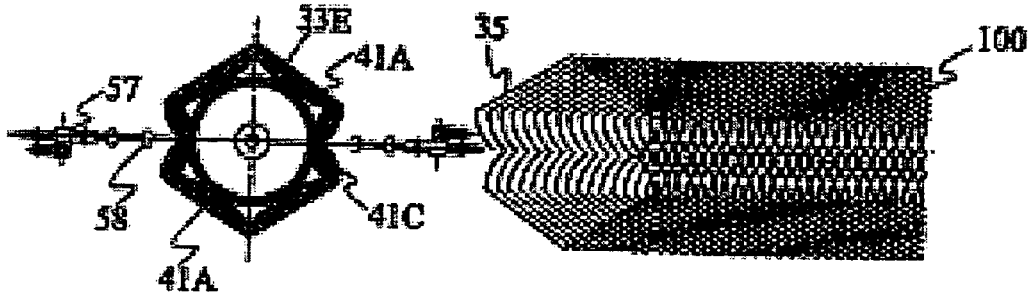
fig.19-F1
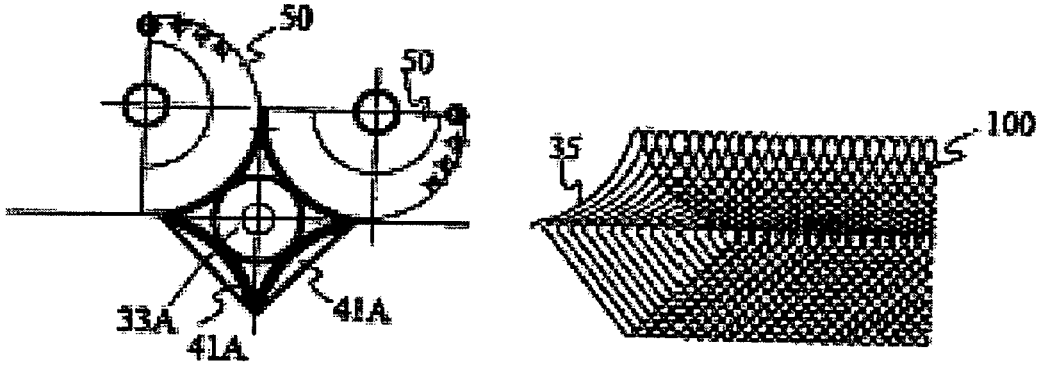
fig.19-F2
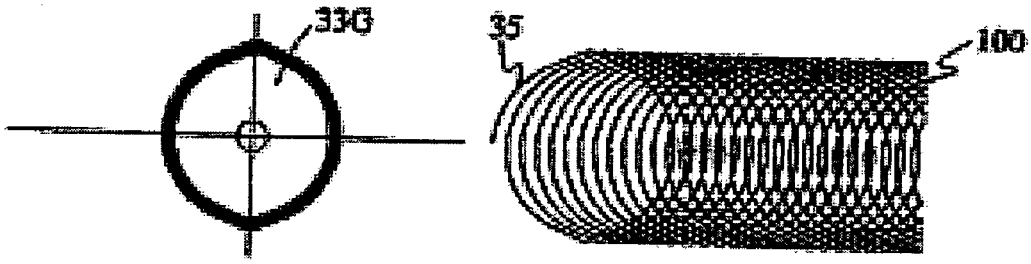
fig.19-F3
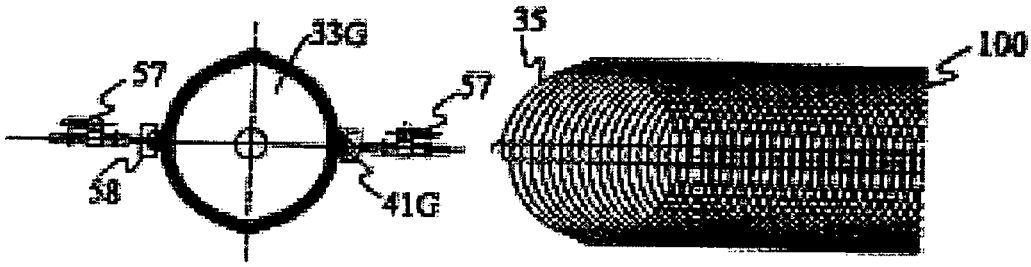
fig.19-F4

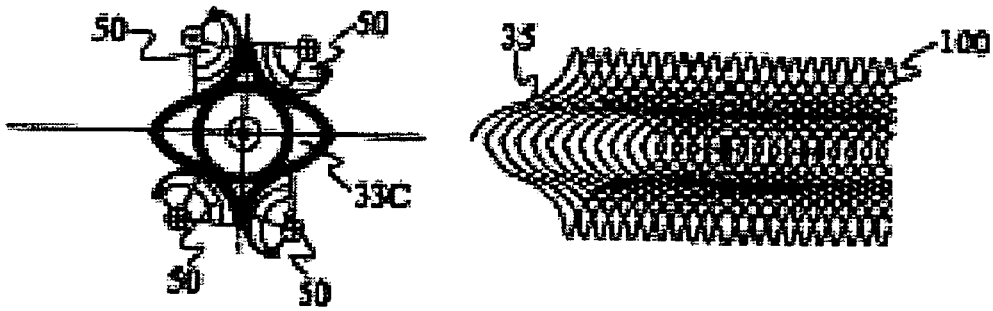
fig.19-G1
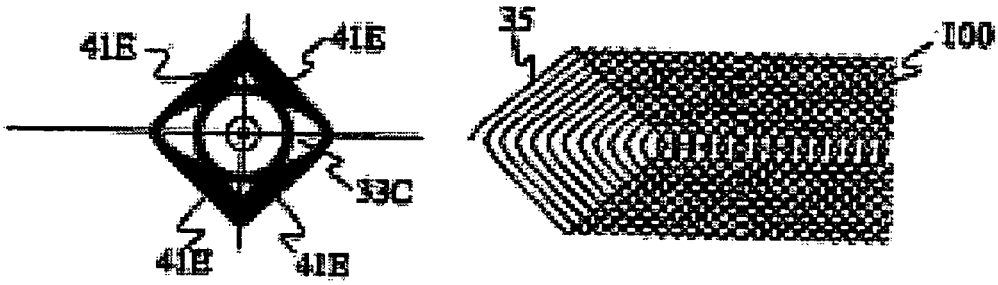
fig.19-G2
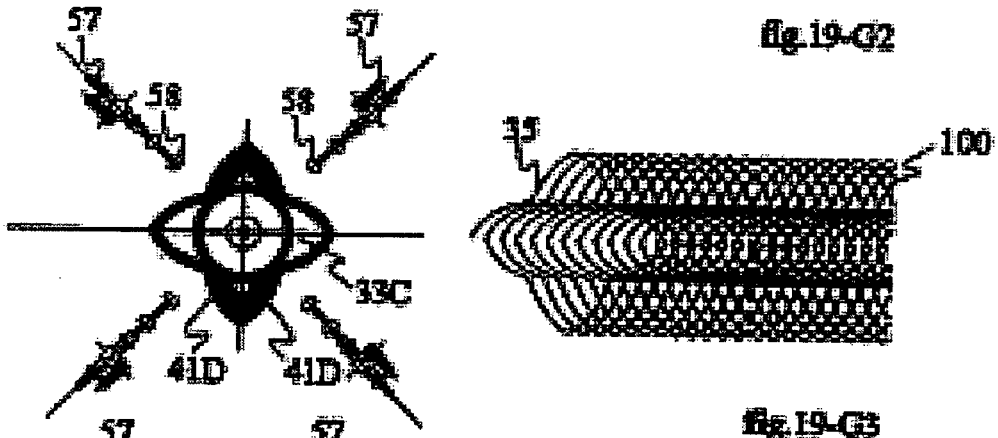
fig.19-G3
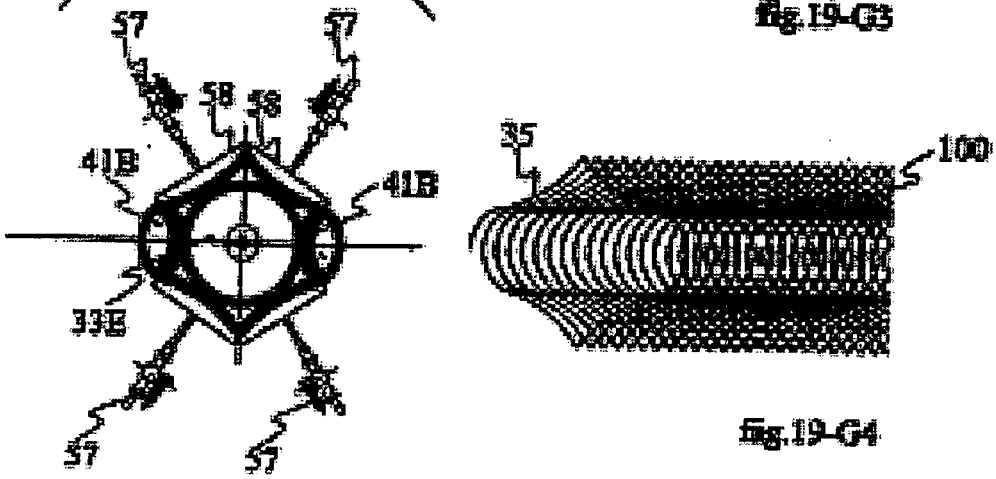
fig.19-G4

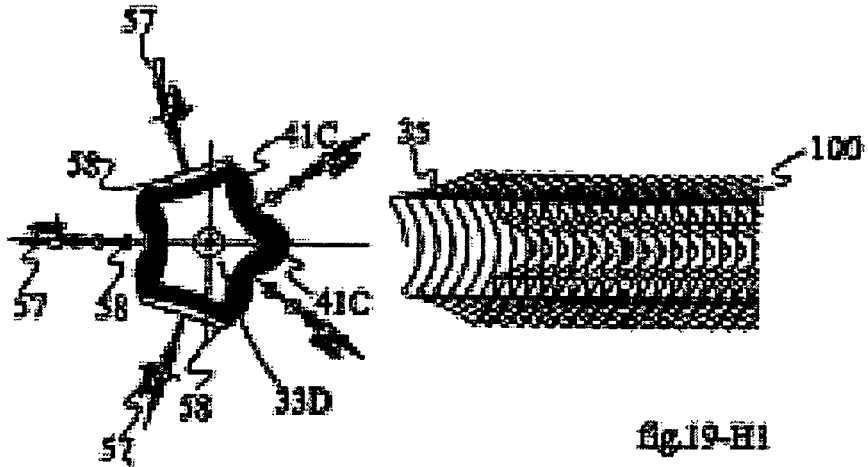
fig.19-H1
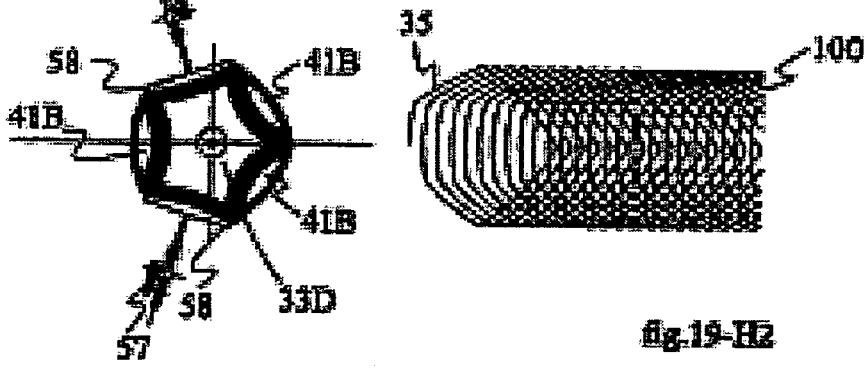
fig.19-H2
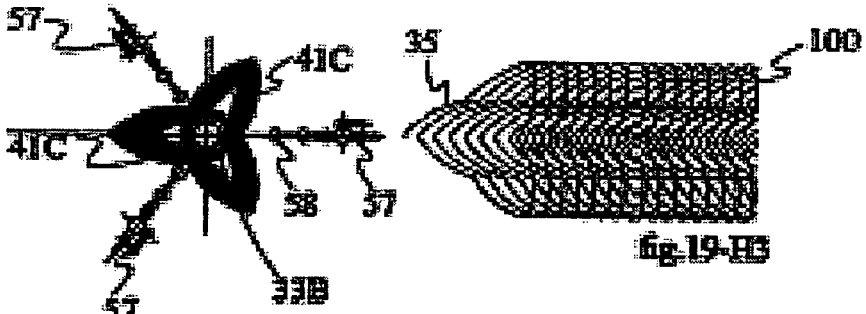
fig.19-H3
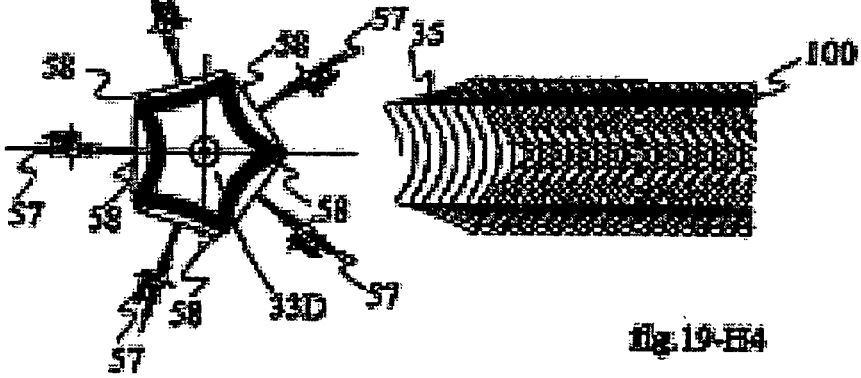
fig.19-H4

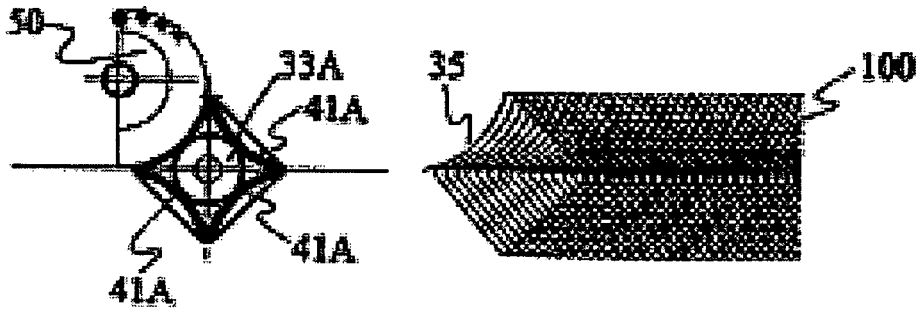
fig.19-J1
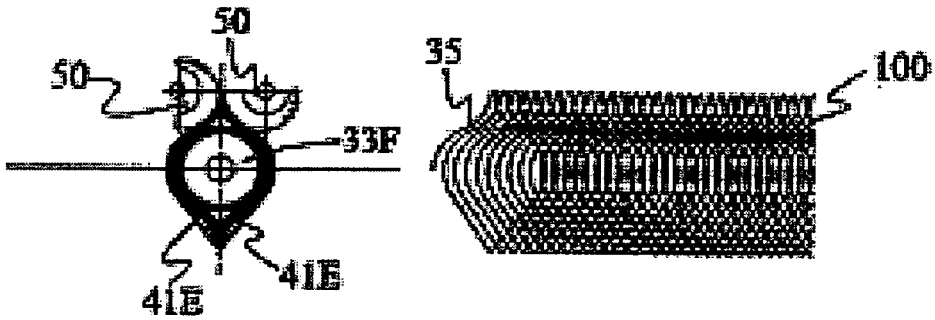
fig.19-J2
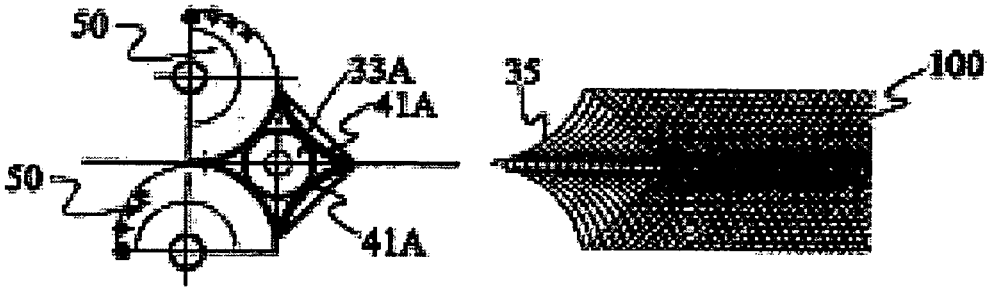
fig.19-J3
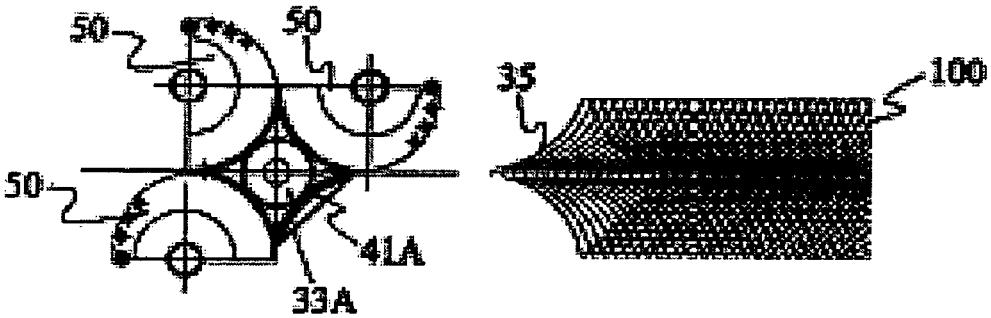
fig.19-J4

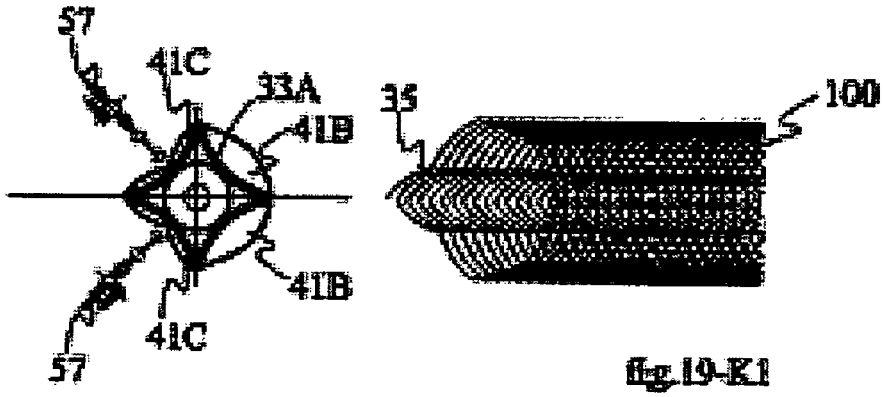
fig.19-K1
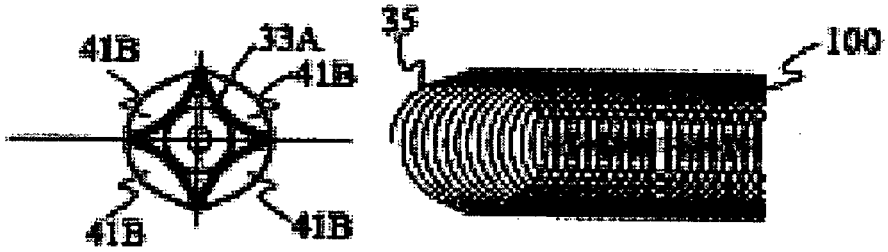
fig.19-K2
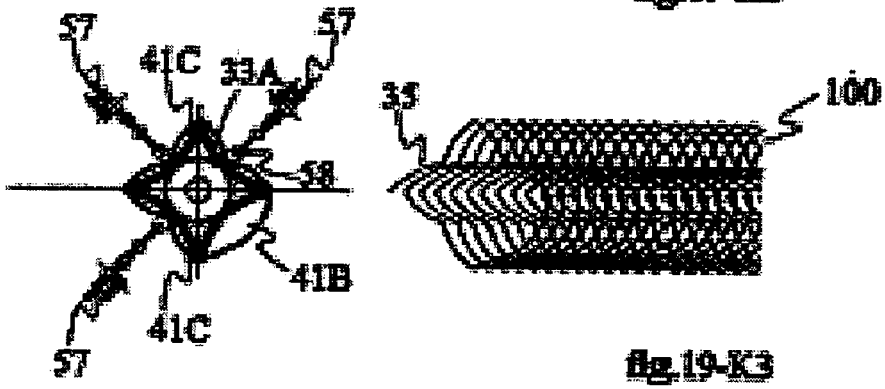
fig.19-K3
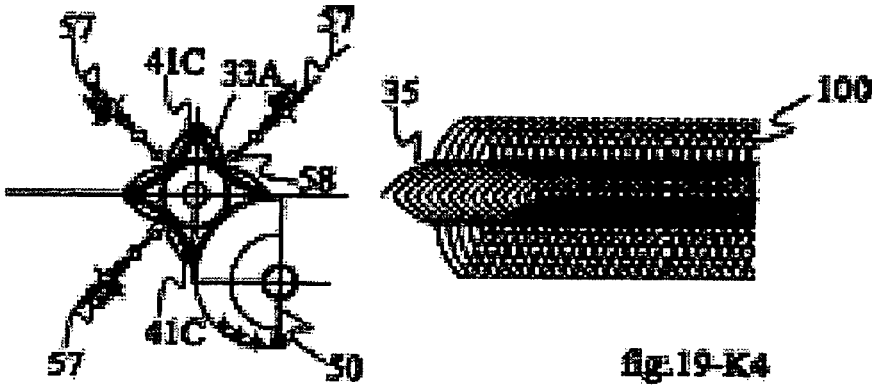
fig.19-K4

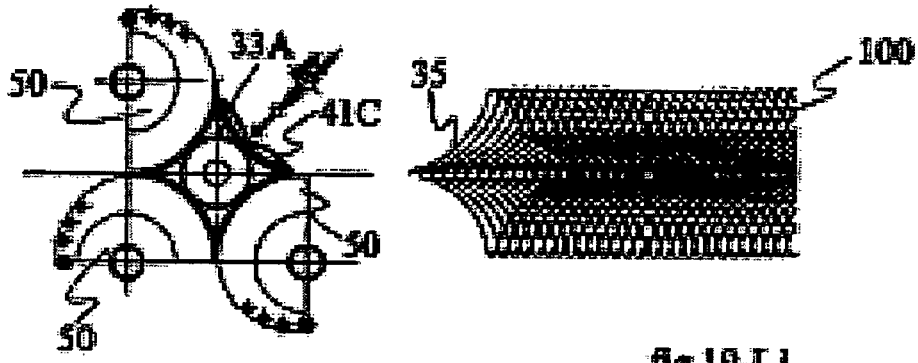
fig.19-L1
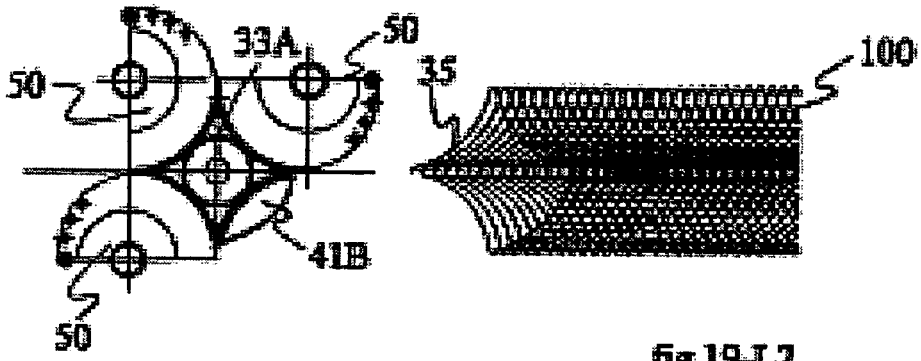
fig.19-L2
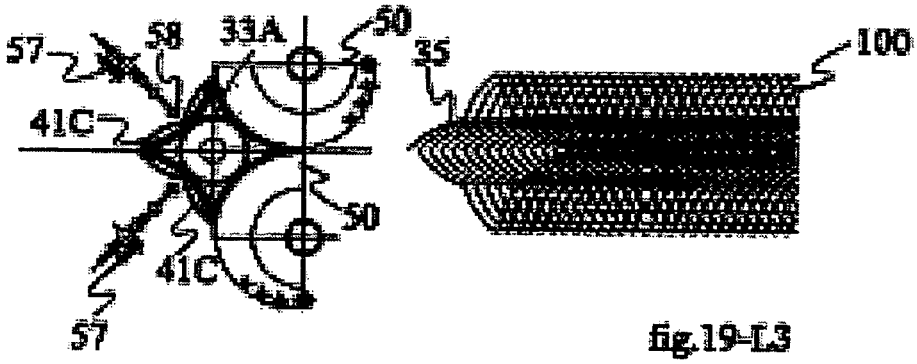
fig.19-L3
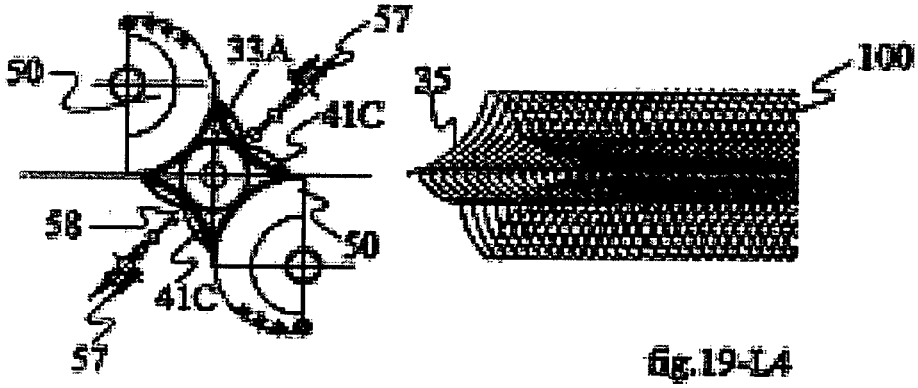
fig.19-L4

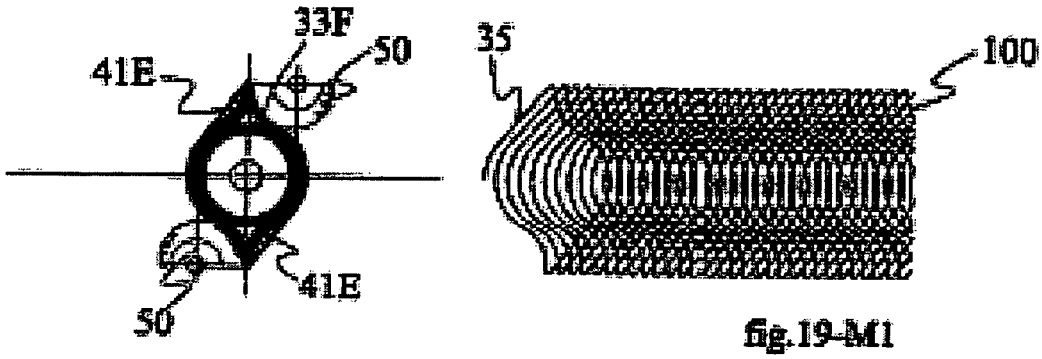
fig.19-M1
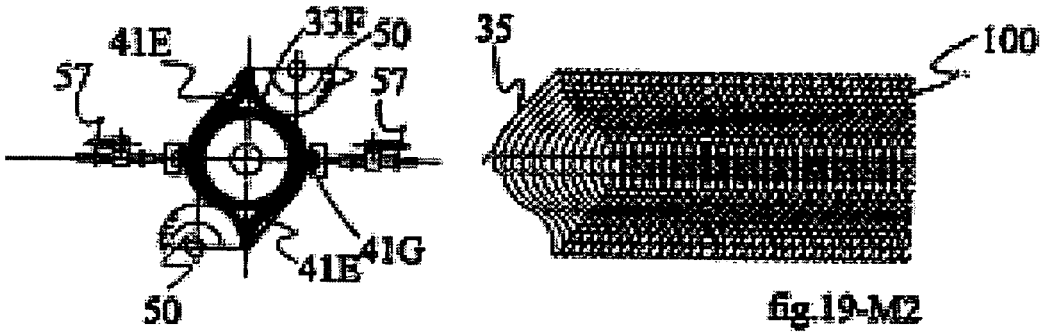
fig.19-M2
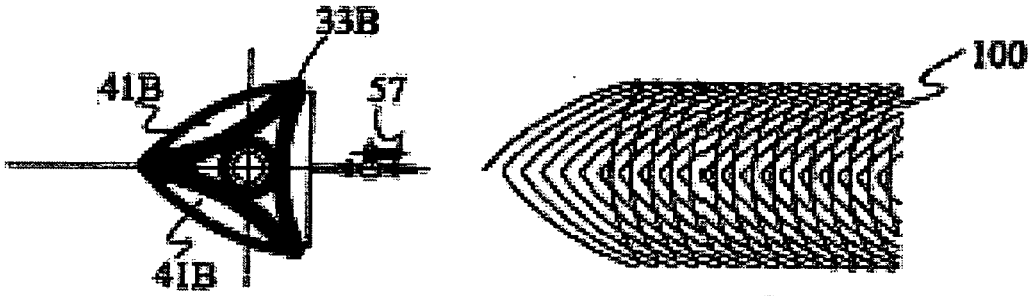
fig.19-M3
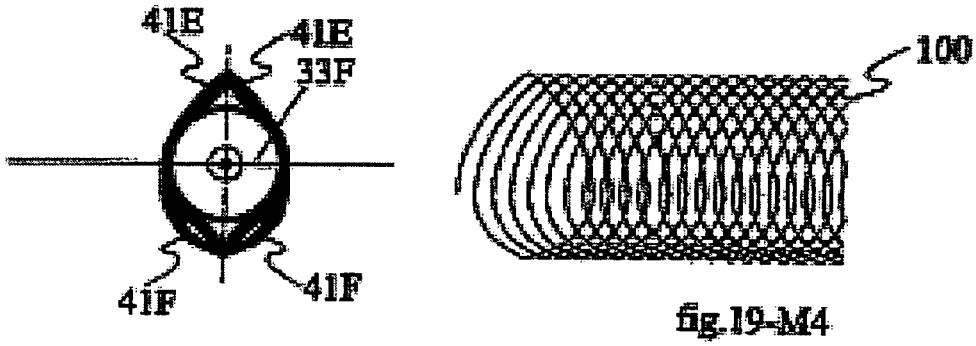
fig.19-M4

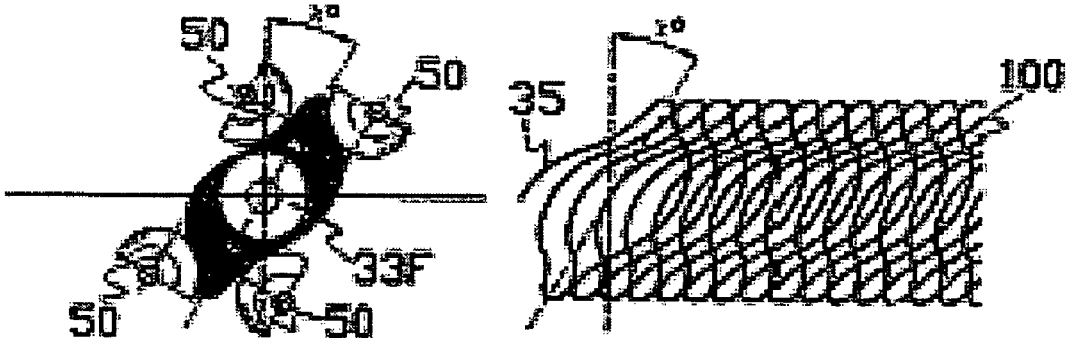
Fig.19-N1
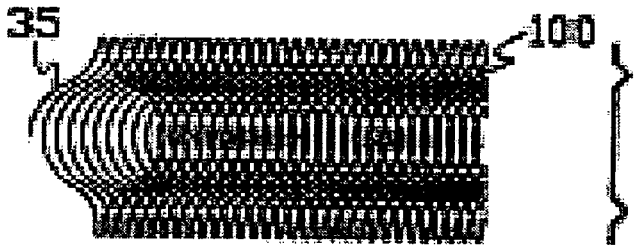
Fig.19-N2
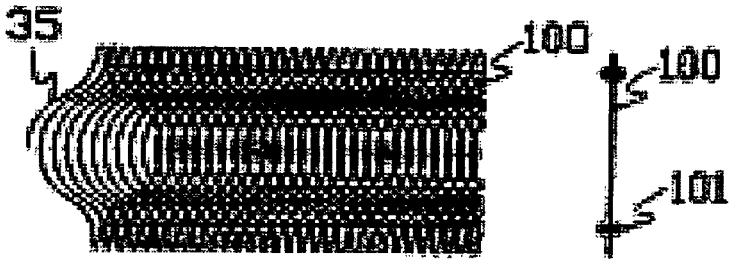
Fig.19-N3

MACHINE FOR CONTINUOUSLY MANUFACTURING A WELDED METAL TRELLIS

The present invention relates to a machine for continuously manufacturing a strip of welded metal trellis with the aid of a single metal wire, as well as a manufacturing method for operating said machine and, finally, the resultant single-wire welded metal trellis.

Lattices of this type lend themselves to a broad variety of possible applications, in particular due to their decorative appearance, and may be used in gardens or public places, houses and public or private buildings and, more generally, in any type of construction frequented by man.

Currently, lattices are generally produced by machines which use a plurality of longitudinal wires which are unreeled from several separate reels and placed in a parallel arrangement. The number of these reels is variable and is traditionally between eight and forty eight, depending on the dimensions of the trellis or lattice, and in particular depending on its width, which is determined by the number of wires. After placing said longitudinal wires in a parallel arrangement, secondary wires are welded transversely on a level with their intersection points with the aid of spot welding devices. The resultant trellis has square or rectangular meshes, the dimensions of which depend on the spaces left free between the longitudinal wires and the transverse secondary wires. Such meshes naturally always necessarily have right-angled corners.

This construction technique has a certain number of disadvantages:

The construction process requires the use of several wires and reels, which means that equipment has to be adapted and an appropriate space made available in front of the production machine. Furthermore, using a large number of wires and reels in parallel complicates the process and slows down production, especially because each wire has to be straightened and the unreeling operation controlled.

It is no longer possible to produce a large variety of ornamental motifs in the meshing of this lattice because it is only possible to make rectangular or square meshes with right angles.

The present invention, on the other hand, enables a very large variety of motifs to be incorporated in the meshes of the lattice. Said motifs are not restricted to geometric shapes with right angles in any way but, on the contrary, may incorporate arcs and rounded regions. This result is also obtained without the constraint of having to use a certain number of wires in parallel but using a single wire. This reduces the technical equipment needed for production and the manufacturing machine is considerably simpler, whilst increasing the production speed, capacity and variety.

Reducing the number of wires means that the number of reels is reduced accordingly as well as the space required upstream of the manufacturing machine. Generally speaking, the objective of the invention is to propose a machine which is significantly simpler than its predecessors and which enables an infinite variety of motifs to be obtained when producing the lattice.

This machine enables a continuous strip of metal lattice to be produced from a single wire of flexible metal which is fed continuously fed, said lattice being produced by repeating a same motif of metal wire in a plane, each motif being superposed on the preceding motif with an offset of constant pitch in the axial direction in which the strip of lattice is produced. It is essentially characterised by the fact that it comprises:

a stage at which the metal wire is stored;

a stage at which the machine is continuously supplied with metal wire;

a shaping stage at which said wire is configured in a succession of identical motifs;

a transfer stage for displacing each motif of metal wire successively towards the plane at which the strip of lattice is formed;

a stage at which each motif is maintained in a plane and offset at a constant pitch before the subsequent motif arrives;

a stage at which the motifs are affixed to one another.

This machine enabling a continuous strip of lattice to be manufactured additionally incorporates a device for cutting the strip of lattice into lengths downstream of the means for fixing the motifs to one another.

In effect, as is the case with the machines known from the prior art, the stage at which the flexible metal wire is stored simply consists of a reel of wire freely rotating in a support. This single reel takes up only a limited amount of space compared with the multiple reels used to date.

The stage which supplies the machine with metal wires comprises, in succession:

means for straightening the wire, designed to place it in a straight line, at least one pulley for guiding the wire towards a rotary device for winding around a drum.

This drum is in reality an integral part of the last stage, i.e. the shaping stage, which incorporates a shaping drum which is held fixed as the shaping takes place, around which the metal wire is wound. It is the turns resulting from the winding process which constitute the base motifs of the lattice. Although it remains fixed during the shaping operation, this drum can be pivoted with respect to the shaping axis with a view to increasing the number of motifs which can be obtained.

A simple winding around the shaping drum is often not enough for the wire to assume the shape of a wall or exterior surface of the latter. It is for this reason that additional means which constrain the wire so that it conforms to the shape of said drum are provided at the periphery of the latter, and the movement of these means is synchronised with the winding movement of the wire.

The purpose of synchronisation is to ensure that said means are implemented at a correct instant by reference to the production of each turn.

Once they have been made, said turns do not remain wound around the shaping drum but are picked up at the transfer stage, which consists of an unreeling drum coaxial with the shaping drum and equipped with helical worms, operated in a rotating movement synchronised with the winding speed of the wire, which enables the turns forming the motifs of the lattice to be separated.

Devices which enable each turn to be deposited on the shaping plane of the lattice are then disposed on the periphery of the unreeling drum, on a level with its end remote from the shaping drum, and the movement of these devices is also synchronised with that of said unreeling drum.

In summary, once they have been shaped, the turns forming the base motifs of the lattice are separated from one another, then deposited in a same plane in which the lattice strictly speaking is assembled.

The stage enabling each motif to be retained in the shaping plane of the lattice and offset by a constant pitch before the arrival of the subsequent motif consists of a plurality of endless belts, disposed parallel and driven at the same speed, which is synchronised with the shaping speed of the motifs of metal wire, said belts having teeth at regular intervals enabling each motif placed on the plane which they form to be driven.

The speed of said belts specifically influences the spacing of the different motifs and hence the meshes, i.e. the shape and surface of each mesh.

The base motifs forming the lattice are therefore positioned one relative to the others before being finally secured in said position. The means for fixing the motifs of metal wire to one another comprise at least one weld spot disposed transversely to the axis along which the lattice is fed, which may be preceded by a device enabling the motifs disposed in a same cross-section to be held in contact. It should be pointed out that the welding process may be performed by at least one bridge, either in a vertical direction or in a horizontal direction.

The strip of lattice is then complete.

Now that the general means constituting the machine for manufacturing the lattice have been outlined, a more detailed description of them will now be given.

Accordingly, the winding device specifically comprises a hollow rotating shaft, through which the wire passes after being guided by at least one pulley orienting said wire towards said shaft, the outlet of which is fitted with a pulley for reorienting the wire in a radial direction towards an external winding pulley, the axis of which subtends an acute angle with the rotation axis of the reeling device. The circular displacement of this pulley has a radius bigger than that of the winding drum.

By preference, said winding device is operated by an electric motor.

The speed of this electric motor as well as the positioning of the external winding pulley specifically constitute the bases on which the machine as a whole is synchronised.

The shaping drum is disposed coaxially with the winding device, in the extension of the hollow shaft.

By preference, radial spring-mounted rams hold the wire wound around the drum. Their purpose is to prevent the turns from relaxing around the static shaping drum before entering the subsequent stage.

As mentioned above, if the drum does not have any indented surface, a simple winding may suffice to obtain the definitive shape of the turns. If, on the contrary, it has at least one indented surface, i.e. concave, a corresponding number of devices for applying the wire against said surface or surfaces is provided at the periphery of said drum, in which case the movement of this or these device(s) is synchronised with the speed transmitted by the winding motor.

By virtue of one option, the device designed to apply the wire against a concave surface, causing it to assume the shape of an indented arc, consists of a rotary element with an axis of rotation parallel with the axis of the drum and equipped with a wing perpendicular to said axis, the external edge of which is equipped with means for guiding the metal wire and has a contour which one section conforms to the shape of the concave surface.

By preference, said wing comprises two sections, a first section with an elliptical external edge provided with at least one guide roller for the metal wire, and a second section with a contour continuing from the first forming an arc of a circle and having an edge parallel with the axis of rotation, provided with a guide groove, and the device for positioning the wire is prevented from rotating so that the elliptical section penetrates the concave shape of the drum first of all.

Even more preferably, a plurality of rollers for guiding said elliptical section are distributed along its edge with a roller of a bigger diameter being mounted at the end of said section which penetrates the concave shape first.

These applicator devices are adapted for the situation where at least one portion of the external wall of the shaping drum has a concave surface. In the case of a simple indentation, for example of the type comprising a groove diverging towards the exterior, the device designed to apply the wire in said indentation of the wall of the drum consists of a ram, the detachable head of which is of a shape conforming to said indentation, and said head can be moved in translation with a displacement synchronised with the winding speed.

In this case, in one possible embodiment, the ram is controlled by a motor which actuates, via a gear, a rack mounted on the shaft, to the end of which the head is fixed. Alternatively, the ram may also be actuated by a piston or by a linear motor At this stage of manufacturing the lattice, each turn assumes the precise shape of the shaping drum and is ready to be displaced towards the shaping plane of the lattice, of which it constitutes a base motif. The turns are then separated by an unreeling drum and at least one fixed device for axially guiding the turns is placed along and in the extension of said unreeling drum. Said guide is effectively provided in the form of at least one internal guide disposed facing an external guide. Each pair of guides bounds a passage conforming to the shape of each turn and, depending on the worms of the unreeling drum, is disposed at least at a point where the motif has a protuberance towards the exterior.

At this stage, each base motif of the lattice (an unreeled turn) is separated and is ready for use in manufacturing the lattice. The devices enabling the unreeled turns to be deposited on the shaping plane of the lattice then consist of endless screw shafts disposed at regular intervals at the periphery and in the axial extension of the unreeling drum, said shafts being driven by electric motors which are synchronised so that they are actuated in succession and enable one turn constituting a motif of the lattice to be extracted gently after the other.

Having been unreeled by the helical worms, the turns arrive at the outlet of the unreeling drum and guide devices, in a plane with an orientation that is not strictly perpendicular to the axis of these devices. It is therefore preferable if the endless screws which pick up each turn are actuated individually in succession or in groups, depending on the positioning of the portion of the turn which they pick up.

Each turn or base motif of the lattice is then deposited on the shaping plane, which operation is operated by successively offsetting each motif, and consists of a central chain and two lateral chains fitted with teeth for driving said motifs, which are driven by motors synchronised with one another and with the motors of the devices with endless screws.

Said chains preferably have mounted above them a guide belt and fixed rigid guard means designed to conserve the relative positioning of the turns.

Furthermore, slide plates are disposed underneath the lattice, at the ends of the chains located at a distance from the system used to manufacture the motifs.

At this stage of the manufacturing process, the lattice is shaped but the base motifs forming it have not been affixed to one another.

Said fixing process is operated by means of two transverse welding bridges operating in a vertical direction, each preceded by a bridge for retaining the motifs forming the lattice, each bridge being equipped with two heads disposed on either side of the lattice, each effecting an action in the direction of the other head.

The heads of the retaining bridges are preferably detachable and have male and female areas of relief respectively matching the motifs forming the lattice and enabling interpenetration designed to place said motifs in contact with one another in readiness for welding.

On a level with the welding, the turns are therefore perfectly in contact with one another.

The welding bridges apply a spot weld to at least some of the intersections of the motif in a transverse direction, preferably twice at two transverse patterns of the intersecting points of the motifs forming the lattice.

In effect, the repetition of base motifs, simply offset from one another, often leads to two transverse patterns of alignment of the intersection points, thus requiring the presence of two separate vertical welding bridges.

However, there may also be a welding bridge operating in a horizontal direction, by means of at least a pair of extractable heads which can be inserted in two successive meshes of the lattice in the direction in which the latter is fed.

It should be pointed out that the lateral chains extend as far as the first welding bridge, whereas the central chain extends as far as the second bridge.

The main element of this machine is still the shaping drum because it determines the entire pattern of the lattice. It has a main body to which at least an additional volume can be attached, designed to modify a portion of its external shaping wall.

This option considerably extends the variety of base motifs which can be produced for the lattice.

In particular for example, the additional volume might be such that it is inserted in at least a portion of the concave surface of the wall of the drum in order to define a new portion of external wall, for example flat or convex.

It is also possible for the additional volume to be designed so that it is inserted in at least one portion of the concave surface of the drum wall in order to define a new portion of wall incorporating an indentation.

In one possible configuration, the machine proposed by the invention may have at least one additional reel of wire disposed at the side of the shaping plane for the lattice, in which case the wire is directed towards a face of the strip of lattice during feeding and is re-oriented parallel with said feed direction and then fixed to the strip of lattice.

There are preferably two or four reels, in which case the wires are directed respectively to one or to the two faces of the strip of lattice.

The machine proposed by the invention may also incorporate a stage at which at least one transverse portion of the strip of lattice is axially continuously shaped. By virtue of one option, the shaping may be effected in two transverse portions alongside the borders of the strip of lattice.

The machine may naturally be automated by means of a central electronic unit for managing the machine, the parameters of which can be controlled by means of peripheral devices accessible to the user, and said central unit processes the signals emitted by sensors indicating the instantaneous state of certain moving components of the machine.

The peripheral devices accessible to the user are preferably a monitor and a keyboard.

Even more preferably, said central unit and the peripheral devices form part of a micro-computer containing a programme for managing the machine.

Finally, the elements of the machine on which sensors are placed are the control elements of the different rotating elements, namely the electric motors. These sensors provide information about the position and speed of each of the motors, and the central unit on which a programme is run for managing the machine applies a relative synchronisation of all of these motors in order to operate the machine as described.

As mentioned earlier, the invention does not relate solely to the machine for manufacturing the continuous strip of lattice but also to the strip of lattice manufactured with the aid of this machine, which is characterised by the fact that it is formed by repeating a single motif offset along the axis along which it is made, said motifs being welded to one another on a level with at least some of their intersections.

As mentioned above, the strip may be provided with at least one wire on at least one of its faces, which is axially fixed to it on a continuous basis.

Alternatively or in addition, it may incorporate continuous axial shaping on at least a transverse portion.

Finally, the invention relates to a method of manufacturing a strip of lattice continuously by means of a single metal wire, characterised by the following steps:

- winding the metal wire around a shaping drum so that each turn assumes an identical motif;
- separating the turns in the direction of the axis of the shaping drum;
- depositing the turns on a shaping plane of the lattice oriented perpendicular to said axis of the shaping drum;
- continuously displacing said plane, in synchronisation with the speeds at which the turns are wound, separated and deposited, to create an offset between the turns and form the succession of repetitive motifs of the lattice; and
- welding at least certain intersection points of said motifs.

The characteristics of the manufacturing method naturally reflect the capabilities of the machine outlined above.

For example, as a result of the method proposed by the invention and prior to the winding step in readiness for shaping, the wire is continuously unreeled from a single storage reel.

Likewise, the soldering step is followed by a step at which the strip of lattice is cut to the desired length.

The user of the machine may choose the length of lattice to be made at his discretion, either to make runs of predetermined lengths or to make industrial capacity rolls.

As explained, the method is different depending on whether the shape of the shaping drum incorporates hollow parts or not. For example, if the external wall of the drum has at least one concave portion and/or at least one indentation, the process of shaping by winding around a drum is operated by means of a corresponding number of devices designed to apply the wire against said portion of external wall.

The manufacturing method proposed by the invention may be automated with the aid of an electronic central unit or a micro-computer equipped with peripheral devices, enabling it to be controlled by the user and respond to sensors tracking the progress of the different steps implemented during the course of the method.

More specifically, the sensors co-operate with the electric motors, making it possible to ascertain their speed and position at any time.

By virtue of the method proposed by the invention, it is possible for at least one metal wire to be axially fixed on a continuous basis to one of the faces of the strip of lattice. Two or four wires are preferably fixed in this manner along the borders on one or two faces of the strip of lattice.

At least one transverse portion of the strip of lattice may also be axially shaped on a continuous basis after welding the motifs to one another.

The invention will now be described in more detail with specific reference to the appended drawings, of which:

FIGS. 11A to 11H show three welding stages of the machine proposed by the invention as well as the cutting stage, each in a plan view and a side view;

FIGS. 12A to 12C show a front, side and plan view of slide plates co-operating with the central chain;

FIGS. 13A to 13B show a side view and plan view of the slide plate co-operating with each lateral chain;

FIGS. 19-A1 to 19-N3 show, in each case for a lattice based on a specific motif, the shape of the drum, the number and layout of the devices for placing the wire against the drum, the configuration of the resultant lattice and optionally cross-section.

Firstly, it should be pointed out that not each drawing shows all the reference numbers of the elements illustrated in it, to avoid needlessly overloading said drawings. In view of the complexity of the machine, however, each drawing is intended to provide a detailed illustration of a specific part of the machine, in which case it contains all of the references needed for that particular explanation.

Figure 1:
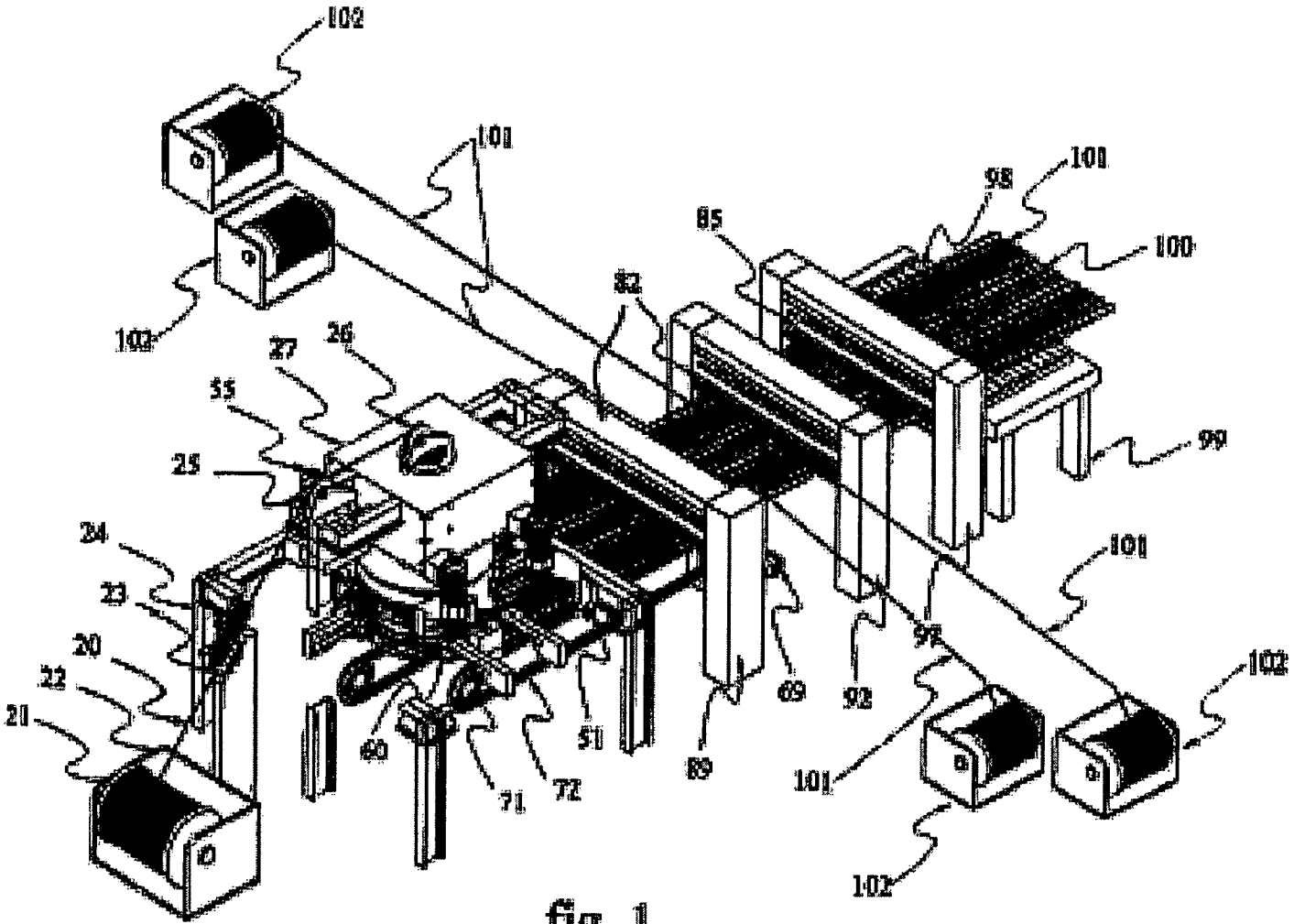
FIG. 1 shows a perspective view of the machine proposed by the invention as a whole.

Turning to FIG. 1, the metal wire (20) supplying the machine for manufacturing a strip of lattice is stored by winding it onto a reel (21) rotating freely in a support (22). On leaving the reel (21), the wire (20) firstly passes through a straightening device (23) designed to eliminate any portions which might be twisted or bent, and then through two pulleys (25, 26) which guide it as far as the inlet of the actual machine itself. The top part of the latter is covered by a hood (27), which is joined to a structure denoted by reference (24), forming the frame of the machine, as are numerous other elements of the machine.

The strip of lattice (100) is made with the aid of a succession of a single motif forming the base structure of said lattice (100), which is repeated at an offset of constant pitch. The strip of lattice is therefore manufactured continuously by adding the same motif in succession on a plane formed by three endless chains (72) on which each motif forming the base of the lattice (100) is placed. The speed at which said chains (72) are driven, generated by drive motors (69) synchronised with the production speed of each motif, enables the pitch separating two successive motifs to be determined. Each motif of the lattice base is deposited with the aid of endless screws (60) distributed around the vertical structure forming the machine, which manufactures each motif using a method which will be described in more detail below.

Downstream of this machine and in order to affix the different motifs to one another in order to make a rigid lattice (100), two welding bridges (89, 92) are disposed transversely to the strip of lattice. A cutting device (97) follows the second welding bridge (92) and enables the strip of lattice to be cut into sections of a predetermined length. A table (99) equipped with two transverse rollers (98) enables the sections of lattice to be manipulated at the end of the production run. The two welding bridges (89, 92) as well as the cutting device (97) respectively have a device for retaining the strip at their inlet, comprising two heads disposed on either side of said strip of lattice. The upper heads (82, 85), which may be seen in FIG. 1, co-operate with lower heads and with the welding heads, as will be described in more detail below.

Laterally disposed reels (102) of metal wire enable wires (101) to be added to at least one face of the lattice (100) as it is being made, which are fixed to said lattice (100) in an axial direction.

These wires (101), which are applied longitudinally for example in the vicinity of the lateral borders of the lattice (100) may reinforce the structure of the latter, if necessary. Assuming that they are fixed to the two faces of the lattice (100), they may be disposed facing one another or offset. The change in direction of the wire (101) between its supply phase during which it is substantially perpendicular to the feed axis of the lattice (100) and the welding phase of the latter is effected in a manner known per se, for example with the aid of pulleys (not illustrated).

Figure 2:
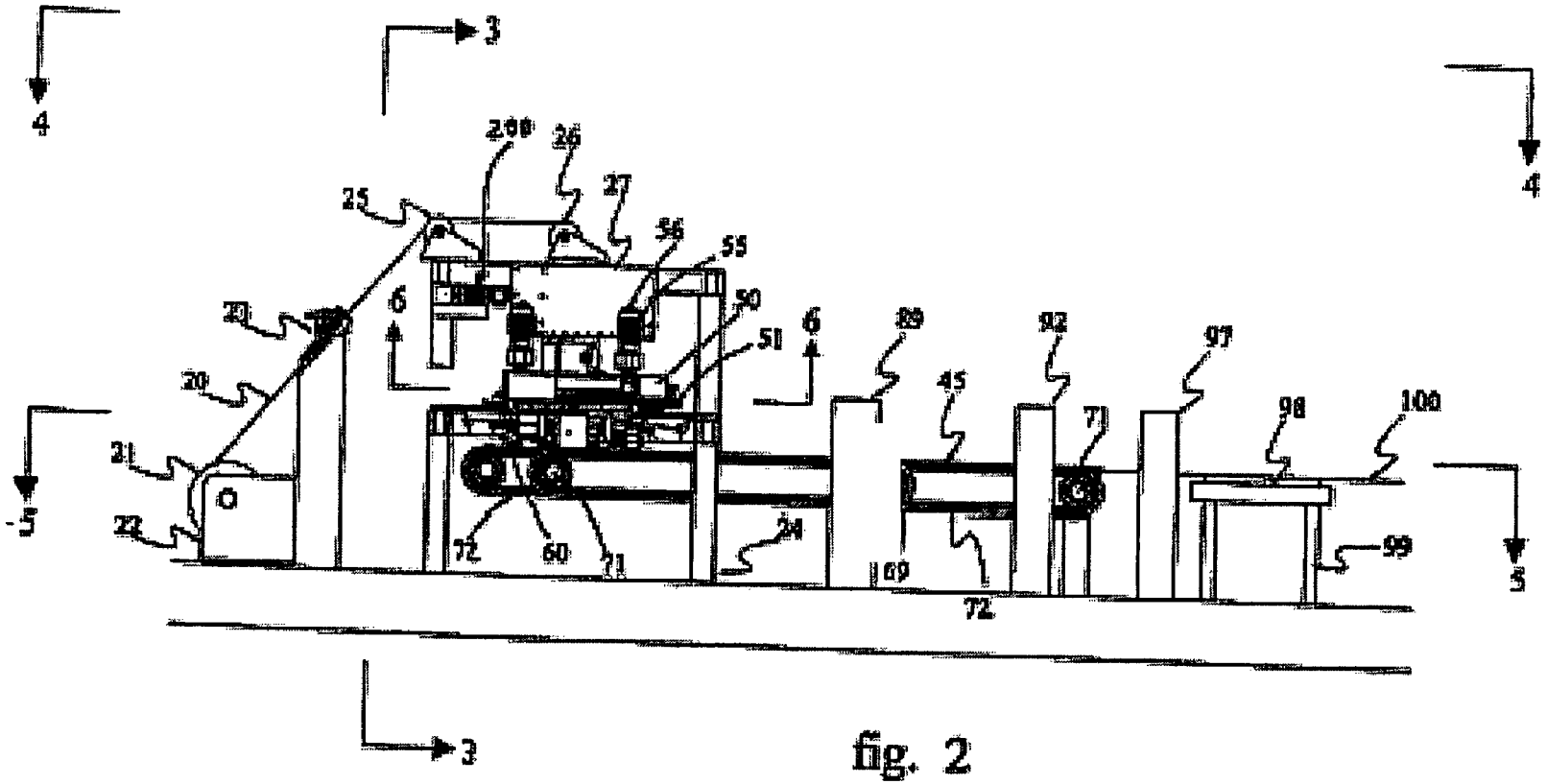
FIG. 2 is a side view of said machine.

FIG. 2 provides an overall illustration of the elements shown in FIG. 1 but with a slightly more accurate view of the central body of the machine, which is of a substantially vertical configuration and disposed in the axis of the hood (27). Made from sections (24), the structure supports almost all of the elements of this machine. The endless chains (72) circulate around toothed pinions (71) disposed at their longitudinal ends, one of which is driven directly by a motor (69). This drawing illustrates the positioning of devices (50) relative to the vertical configuration of the machine, which enable the wire to be positioned in concave portions of the shaping drum, as will be explained in more detail below. These devices, which were already illustrated in FIG. 1, are driven by motors (55) equipped with a position and speed sensor (56) and in particular they are provided with a part (51) which effects said positioning.

Figure 3:
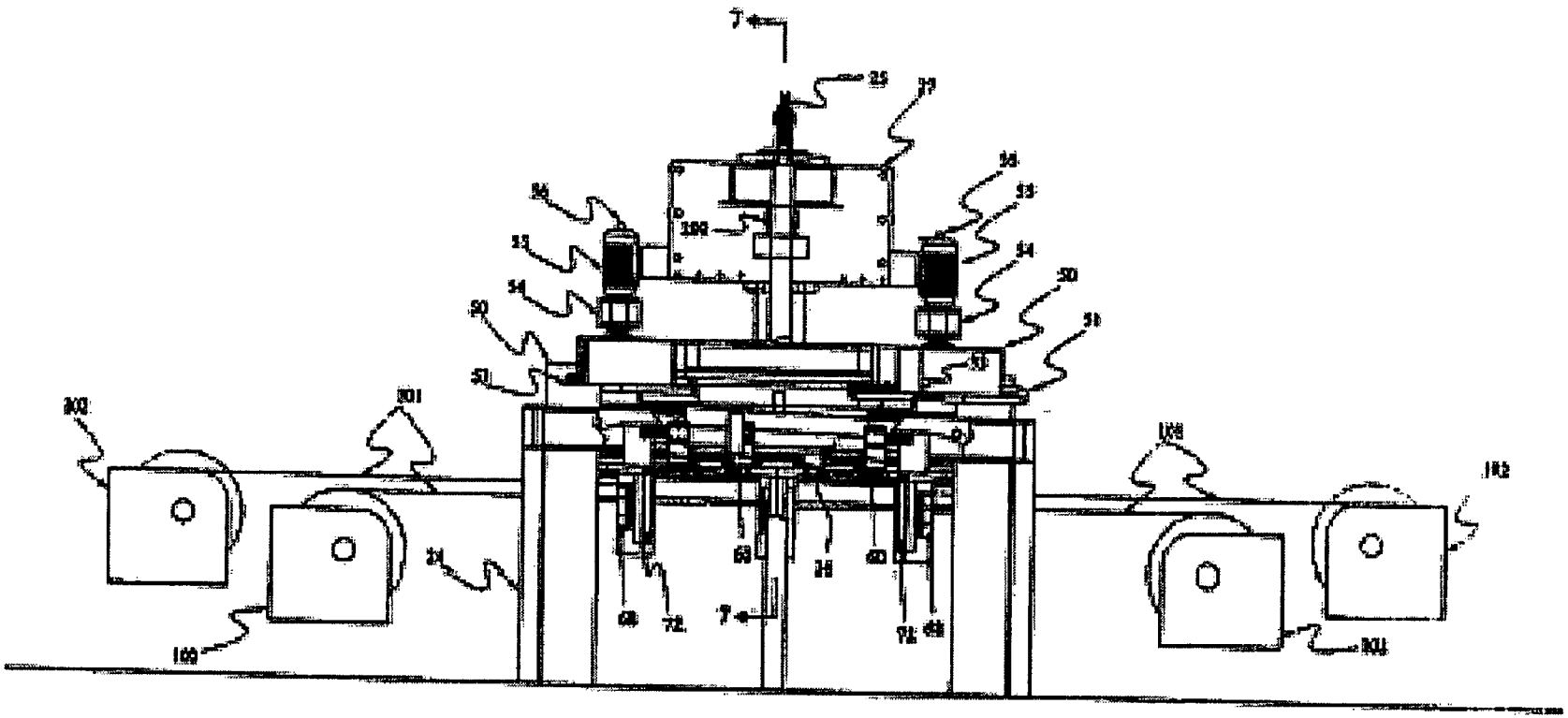
FIG. 3 is a view in elevation along the main axis of the machine, in the direction of arrows 3-3 indicated in FIG. 2.

These positioning devices are also illustrated particularly clearly in FIG. 3, with the motors (55) separated from the active wing (50) by means of a reducing gear (54).

Figure 7:
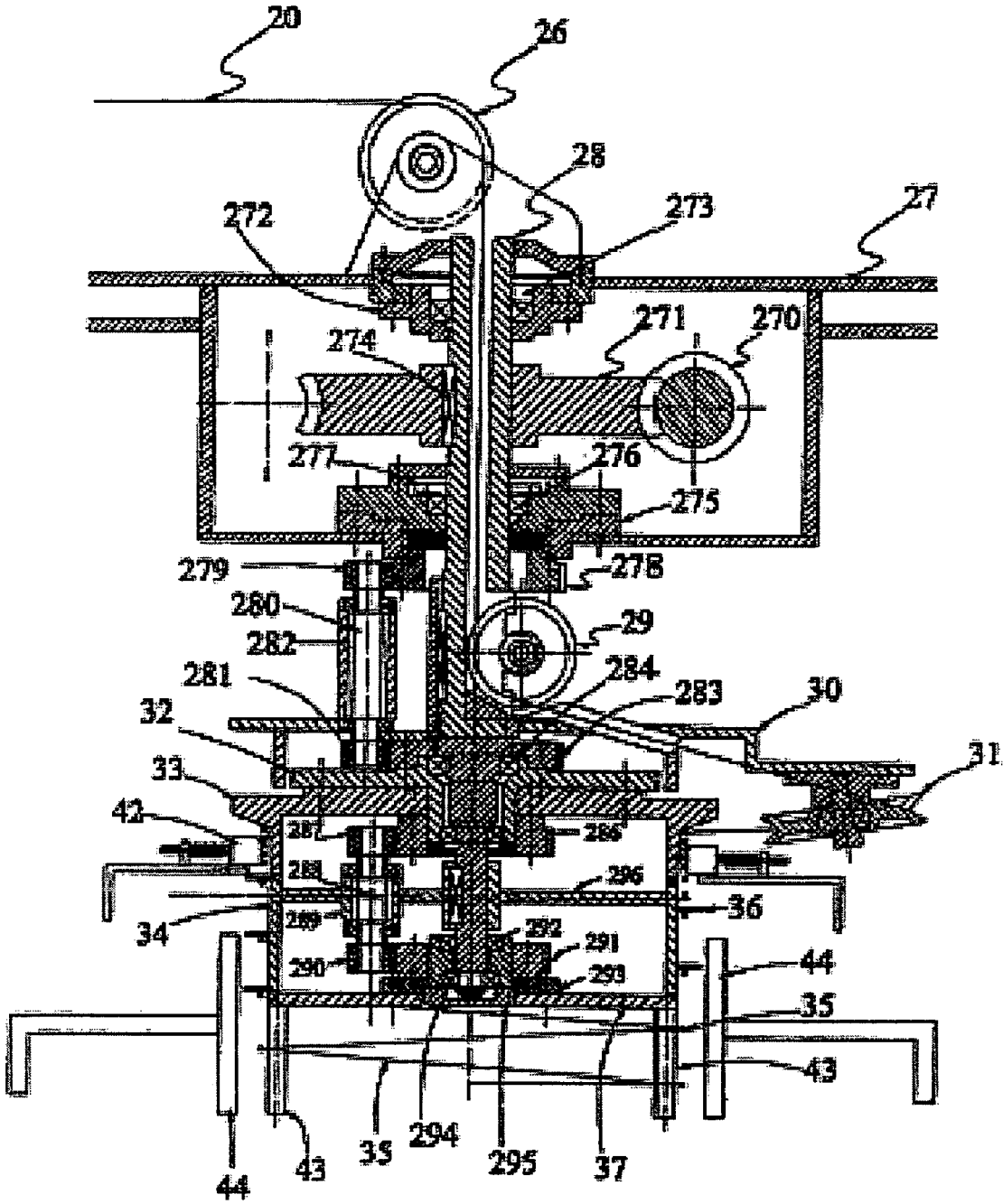
FIG. 7 is a cross section of the machine in the direction of arrows 7-7 indicated in FIG. 3.

The winding device, operation of which is specifically illustrated in FIG. 7, is driven by a motor (299), also illustrated in FIG. 2.

Still with reference to FIG. 3, this view illustrates the unreeling drum (34) and is position relative to the endless screws (60) enabling each turn to be deposited on the endless chains (72). In this drawing, the reducing gears (68) equipping the drive motors (69) of said chains (72) may be seen.

Figure 4:
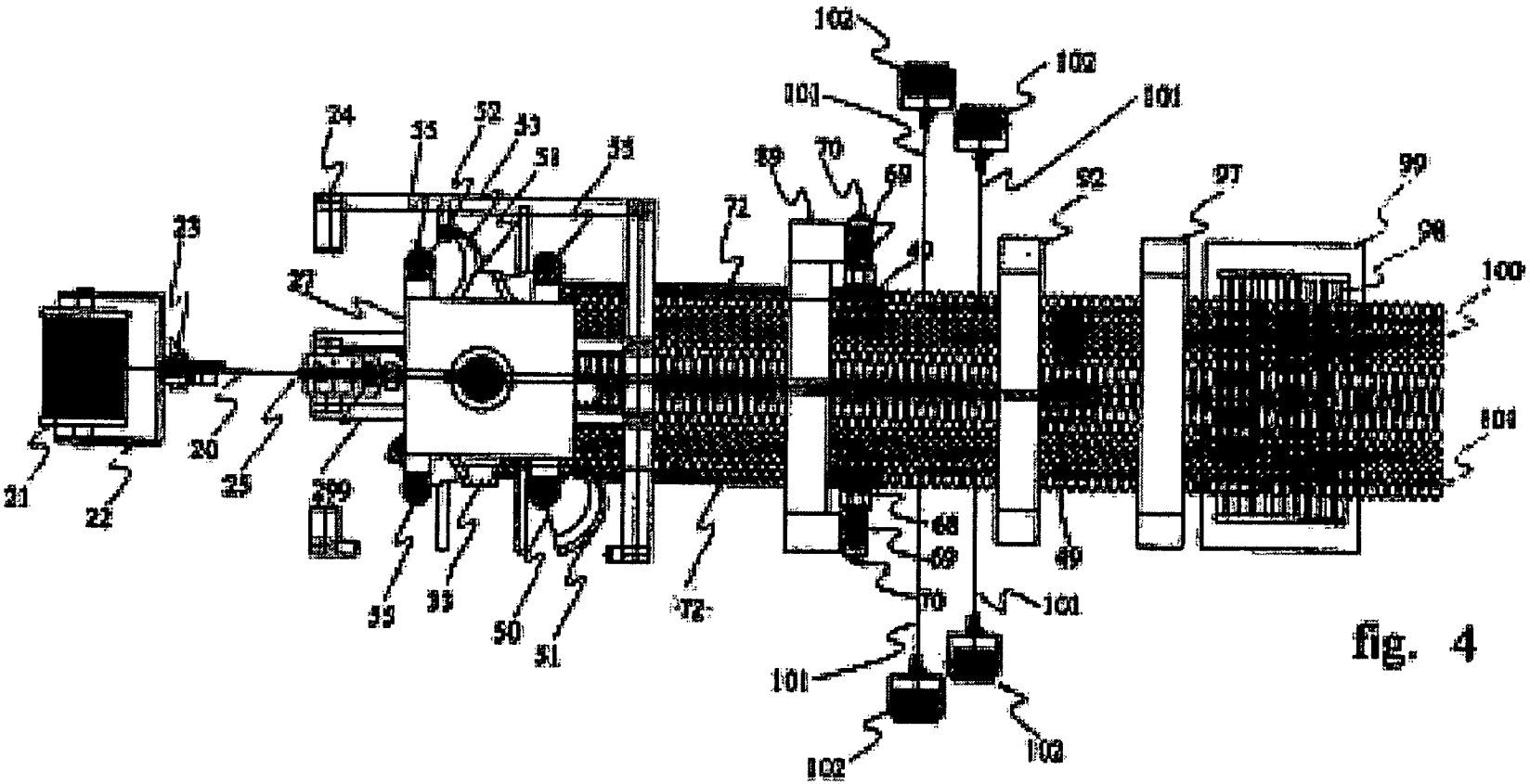
FIG. 4 is a plan view of the machine proposed by the invention in the direction of arrows 4-4 indicated in FIG. 2.

These gear mechanisms (68) may also be seen in FIG. 4, which also illustrates how the drive motors (69) of the three endless chains (72) are fitted with position and speed sensors (70). This drawing also illustrates the fact that the central chain (72) is longer than the lateral chains (72) which terminate downstream of the first welding bridge (89), whereas the former terminates upstream of the second welding bridge (92).

This plan view illustrates a layout in which four positioning devices for the wire are provided, enabling a lattice to obtained in which each motif has four concave arcs, as illustrated.

As will be explained below, the part or active wing (50) of these positioning devices has two portions, the external areas of which constitute two arcs of a different geometry, one continuing after the other, and one of which has guide rollers (52, 53) (see FIGS. 8A to 8C).

It should be pointed out that in all the drawings described so far, some parts of the structure (24) have been omitted to make it easier to read the drawings.

Figure 5:
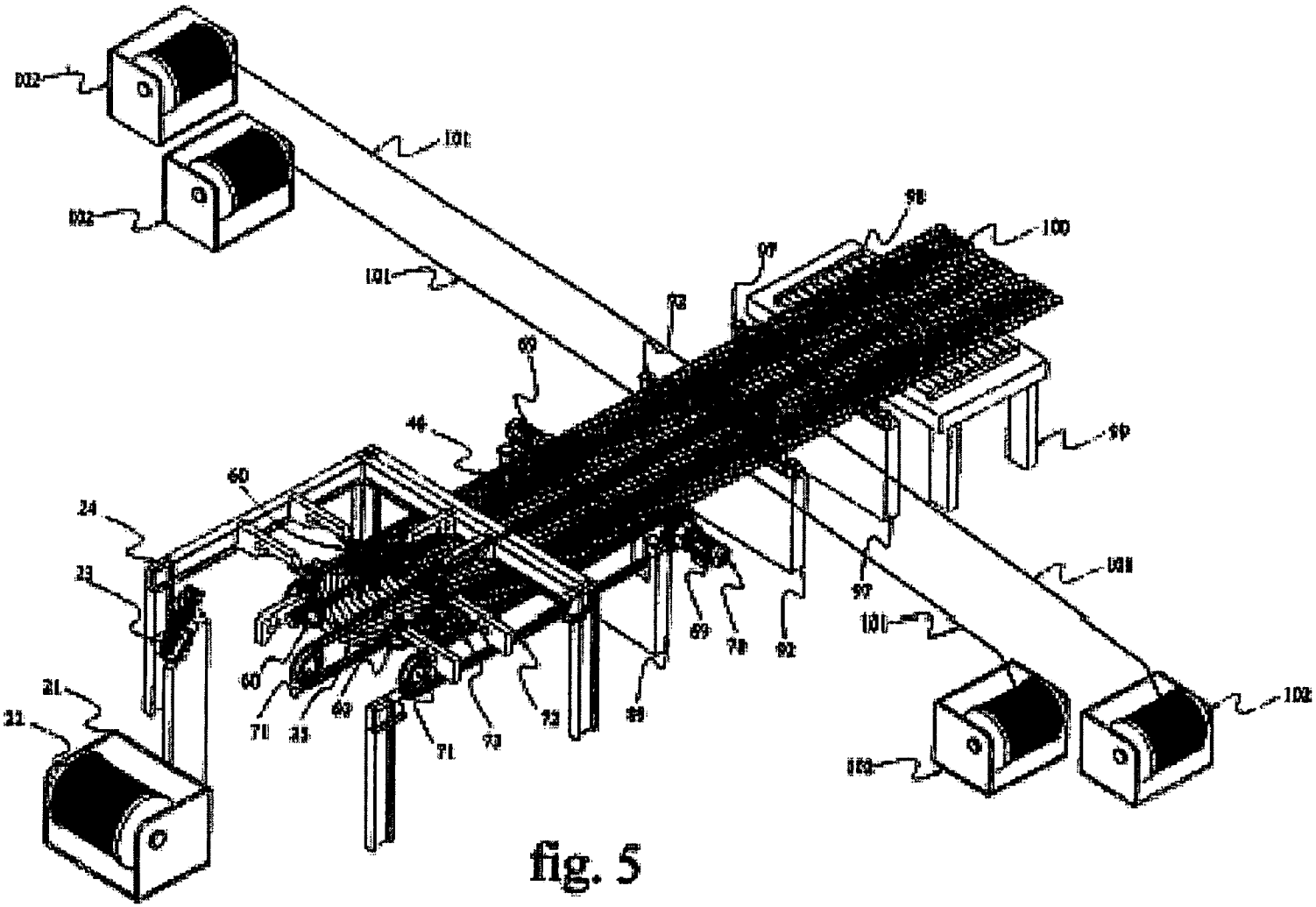
FIG. 5 is a longitudinal section of said machine in the direction of arrows 5-5 indicated in FIG. 2.

FIG. 5 provides a better idea of the plane in which the lattice is shaped, this plane being formed by the three endless chains (72) which are provided with teeth (73) to enable the motifs to be driven once they have been deposited by the endless screw devices (60). There are seven of the latter, for example, distributed on the lower periphery of the machine for making the turns that will form the motifs of the lattice base, and they are preferably actuated one after the other in succession to enable each turn to be deposited flat so that it is effectively inclined with respect to the shaping plane of the lattice (100).

Figure 6C:
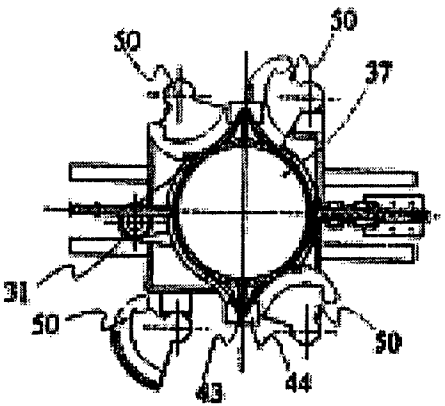
FIGS. 6A to 6D show different views of the top part of the machine, mounted above the part illustrated in FIG. 5, in particular in the direction of arrows 6-6.
Figure 6D:
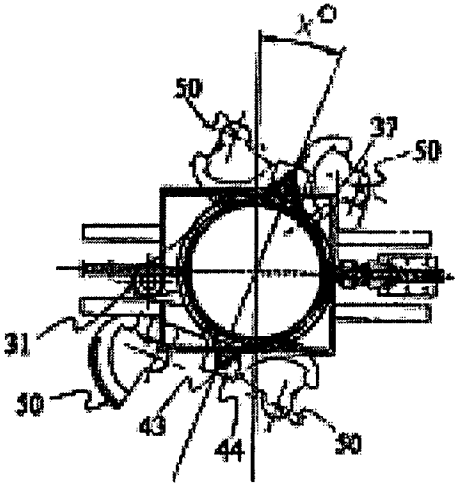
Figure 6A:
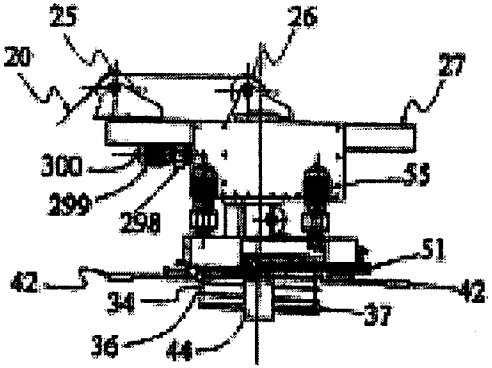
Figure 6B:
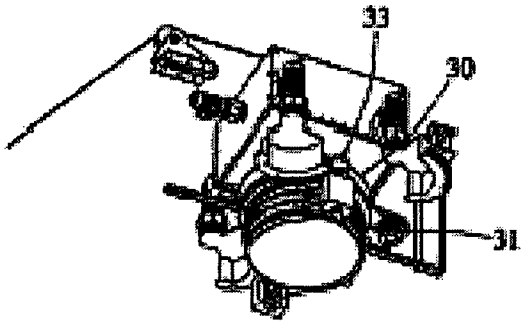

FIGS. 6A and 6B illustrate how the unreeling drum (34) is provided with worms (36) enabling each turn (35) to be separated. On each side of said worms (36), an external guide device (44) prevents said turns from relaxing towards the exterior. FIGS. 6C and 6D specifically illustrate the positioning and operation of each external guide (44), in co-operation with an internal guide (43), said guides being of a shape which depends on the layout of the turns obtained after winding on the shaping drum. In this particular instance, in order to obtain a base motif for the lattice illustrated in FIG. 5, it is necessary to add internal guides (43) forming an excrescence at each end of the cylindrical unreeling drum (34) on a level with each worm (36) for separating the turns (35). The external guides (44), accommodating the internal guides (43), therefore have a corresponding recess. The internal guides (43) are specifically affixed to a plate (37) disposed underneath the unreeling drum (34) (see FIG. 7).

The internal (43) and external (44) guides are not disposed on the same level and therefore copy the inclination of the worms (36). As illustrated in FIG. 6A, the motor of the winding device (device illustrated in detail in FIG. 7), is connected to the latter via a reducing gear (298) and it is equipped with a speed and position sensor (300). In particular, this winding device has an external pulley (31) enabling the wire to be wound around the shaping drum (33), said pulley (31) being joined to a rotating plate (30) as illustrated in more detail in the section shown in FIG. 7.

The angular position of the shaping and unreeling unit may be varied (see FIG. 6D) in order to increase the number of possible motifs which can be made for the lattices proposed by the invention.

FIG. 7 illustrates how the wire (20), after passing via the pulley (26), passes through a hollow shaft (28) driven in rotation by the motor (299) by means of an endless screw shaft (270) driven in rotation by a gear (271) keyed to said shaft (28) by means of a key (274). The rotating shaft (28) is supported so that it can rotate freely in the hood (27) by means of a ball bearing (273) retained in the seat of a ring (272) which is in turn affixed to said hood (27). The same structure, incorporating a ball bearing (276), its associated seat (275) and a fixing ring (277), enables the shaft to be retained in a bottom panel of the hood (27).

At the outlet of the hollow shaft (28), a pulley (29) with the same axis of rotation as the pulley (26) enables the wire to be re-directed in a radial direction with respect to the rotation axis of the shaft (28). Said wire (20) is then directed towards an inclined pulley (31), disposed at the periphery of a rotating plate (30), enabling the wire to be wound around a fixing drum (33). This drum (33) is the shaping drum which imparts the shape of the motif for the lattice base to each turn.

This drum is supported by a plate (32) equipped with a mechanical link to the hollow shaft (28), although it does not transmit the rotating movement of the latter to said plate (32) due to the presence of the ball bearing (284).

However, it is necessary to be able to vary the horizontal position or angle of the shaping drum (33), which is fixed relative to the hollow shaft (28), the rotating plate (30) and the guide pulley (31). Said drum (33) is therefore static, although the shaft to which it is affixed rotates due to the presence of two intermediate gears. One of these intermediate gears (278) is linked to the frame of the winding machine (27), whilst the other intermediate gear (283) is connected to the rotating plate (32). They are linked by two satellite gears (279, 281). These satellites are joined to a sleeve (282) which rotates about a shaft (280) which is supported by the rotating plate (30) connected to the rotating hollow shaft (28), which enables the drum (33) to be immobilised.

Likewise, the bottom plate (37) to which the internal guides (43) in particular are affixed and which has the exact same shape as the projecting portions of each turn formed by the drum (33), is immobile, although it is not fixed to the frame. It is also mechanically linked to one end of the hollow shaft (28) but does not move or rotate with it. The reason for this is that the same structure with two intermediate gears is used, one of the gears (286) being fixed to the shaping drum (33) whilst the other (291) is joined to said bottom end plate (37). These two intermediate gears are linked by satellites (287, 290) disposed on either side of a sleeve (289) and rotating about an axis (288). This sleeve (289) is supported by the unreeling drum (34), which is in turn connected to the hollow shaft (28), as a result of which the plate (37) freely linked to the hollow shaft (28) is left immobile.

The intermediate gear (291) is connected to the central shaft via two ball bearings (292, 294), the latter being protected by a cover (295). The actual plate (37) itself is connected via a support (293) to the intermediate gear (291). It should be pointed out that the unreeling drum (34) has a central stiffening plate (296).

Also illustrated in this FIG. 7 are helical worms (36) to make allowance for the difference in the processing levels of the wire between the internal (43) and external (44) guides disposed on either side of the central axis of the shaft (28).

On a level with the shaping drum (33), ram devices (42) fitted with springs which bias them into contact with the turns during winding enable the winding tension to be relieved.

Figure 8B:
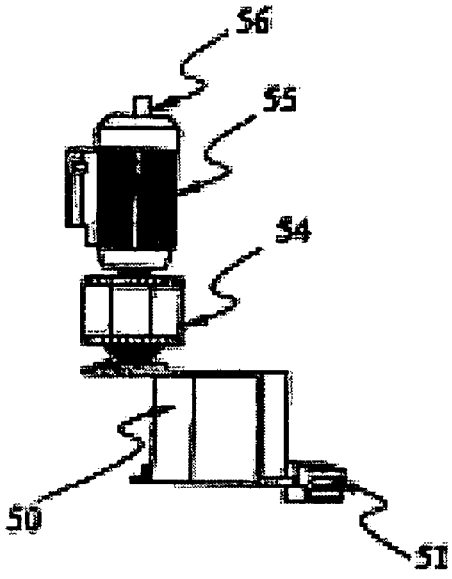
FIGS. 8A to 8C show different views (from the front, side and above) of a device for placing the wire in the concave surfaces of the external wall of the shaping drum.
Figure 8C:
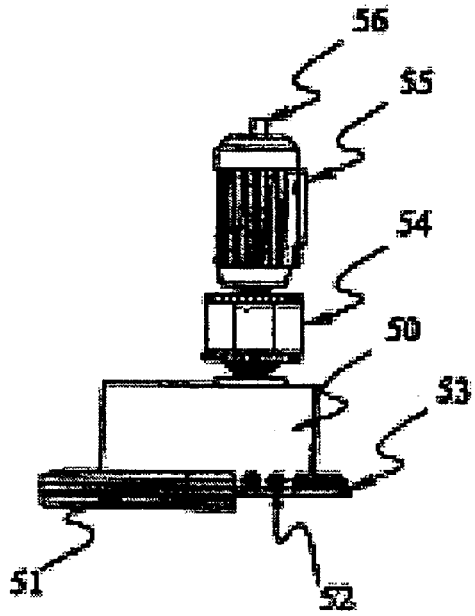
Figure 8A:
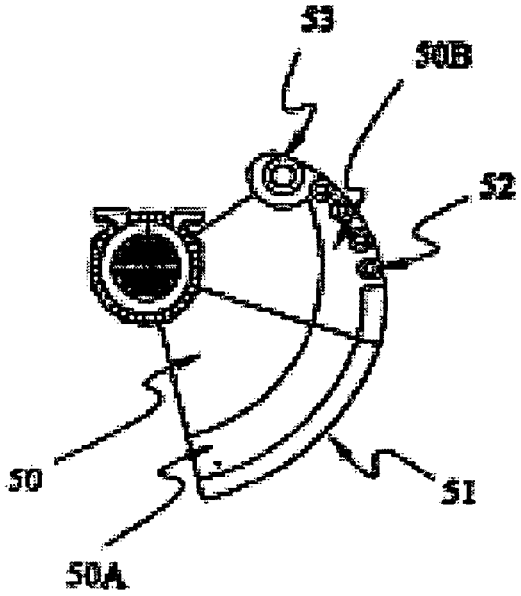

FIGS. 8A to 8C illustrate the exact manner in which the positioning devices place the wire against concave portions of the wall of the shaping drum (33). A description has already been given above of the mechanical part enabling a wing (50) to be driven, equipped with two portions (50A, 50B) with a disposition perpendicular to the axis of rotation and the edges of which are of differing geometry. The edge (52) first of all is an elliptical portion whereas the edge (51) is an arc of a circle. The former initiates the curvature of the wire by means of guide rollers (52, 53), enabling it to conform to the concave surface of the drum (33). The portion of the edge incorporating an arc of a circle (51) has a thicker lateral edge provided with a groove which enables the wire (20) to be guided.

Turning to FIG. 8A, the rotation of the device is based on a trigonometric approach, i.e. the wire is firstly guided by the roller with the biggest diameter (53) and then by the rollers of smaller diameter (52) which start to push it inside the cavity of the external wall of the drum (33), the field (51) terminating the process of positioning in perfect conformity with the concave shape.

Figure 9C:
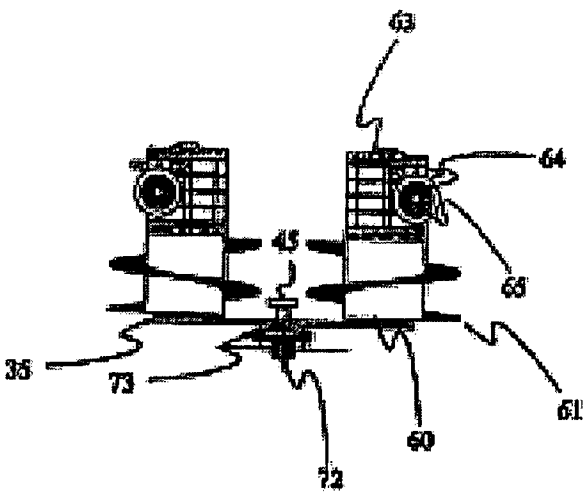
FIGS. 9A to 9C show different views (from the front, side and above) of the devices for depositing the turns on the central chain.
Figure 9B:
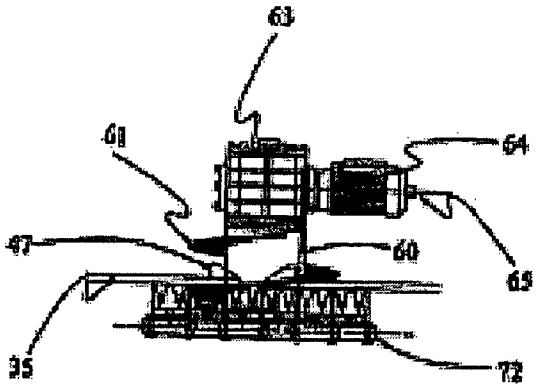
Figure 9A:
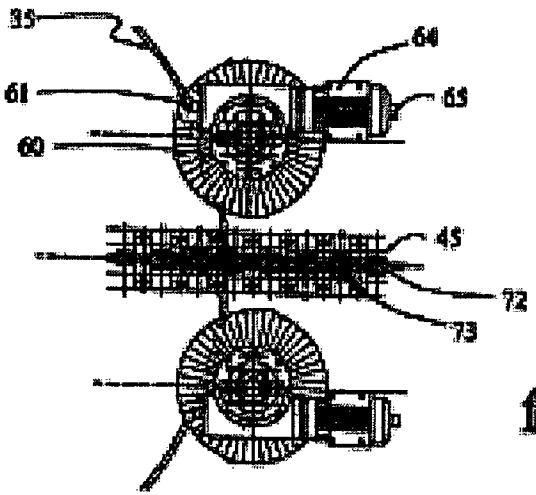

FIGS. 9A to 9C provide a precise illustration of how the endless screws enable each turn to be deposited on the chain (72) provided with teeth (73). Each of the endless screw shafts (60), equipped with helical lips (61), is driven by a motor (64), at the output of which is a reducing gear (63). Each motor also has a speed and position sensor (65). The helical worm (61) starts at the upper part on a level with the bottom end of the unreeling drum (33) (see FIG. 3) and terminates on a level with the base of a cavity of the chain (72) separating two teeth (73). In the example illustrated in FIGS. 9A to 9C, which involves the use of the endless screw devices (60) disposed at either end of the central chain (72), the two motors rotate at the same time but in opposite directions, for example. They therefore enable the turn to move gradually downwards so it can be inserted between two adjacent teeth (73) of the central chain (72). A guard device (45) is mounted above the teeth, although a passage is left open by means of the flared guides (47) to enable the turn (35) to be inserted between two teeth (73) and between the two endless screw devices (60).

Figure 10C:
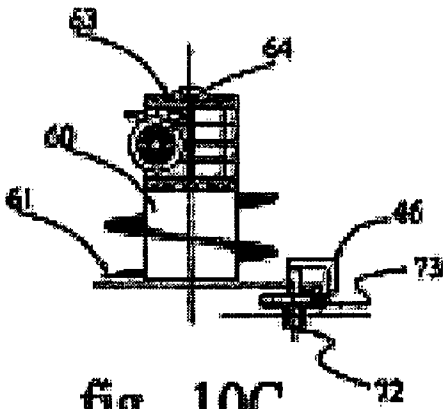
FIGS. 10A to 10C show different views (from the front, side and above) of the devices for depositing the turns on the lateral chains.
Figure 10B:
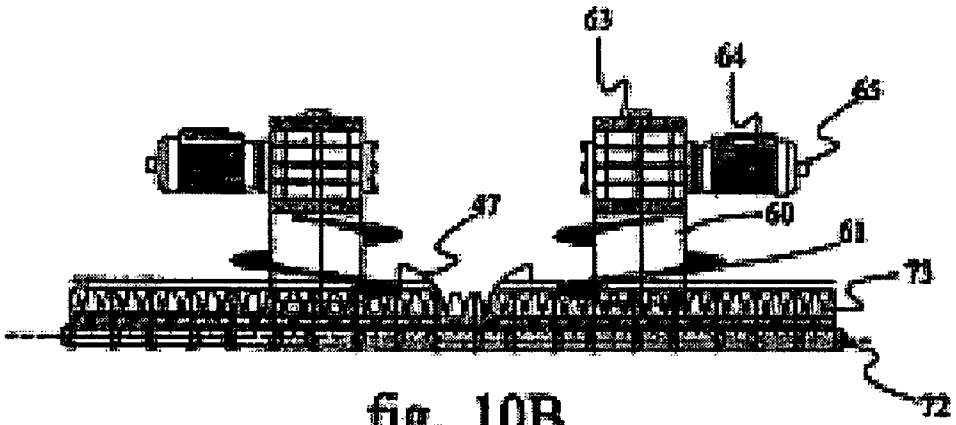
Figure 10A:
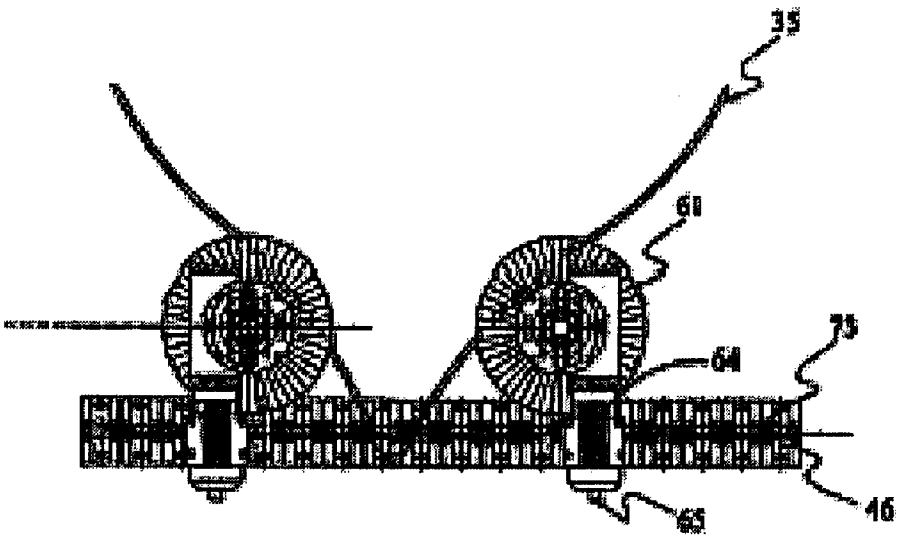

The same layout but in respect of the lateral chains is illustrated in FIGS. 10A to 10C. Due to the angle of inclination of the turn (35), the two endless screw devices illustrated in FIG. 10A are actuated in an offset manner, over time, relative to those illustrated in FIG. 10A and in FIG. 9. An upper guard strip (46) for the lateral chains (72) with an L-shaped section enables each turn to be retained inside the teeth, said strip (46) also incorporating an opening between the two motors for inserting each turn (35), with the flared guides (47).

Figure 11D:
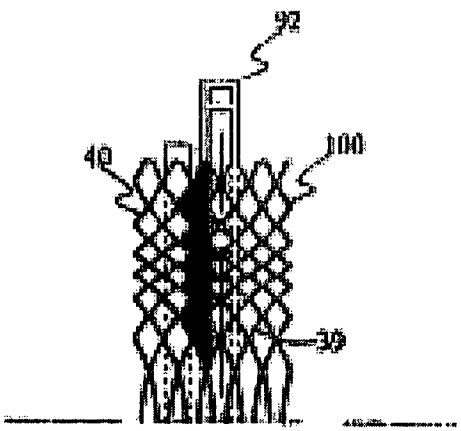
Figure 11C:
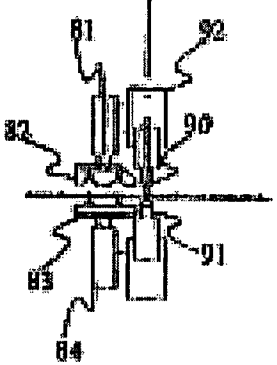
Figure 11B:
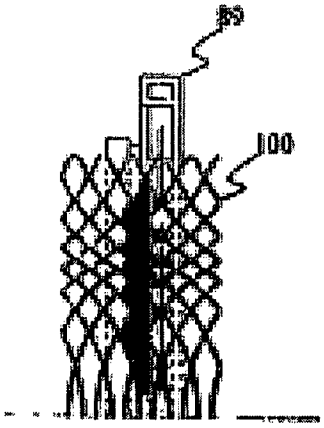
Figure 11A:
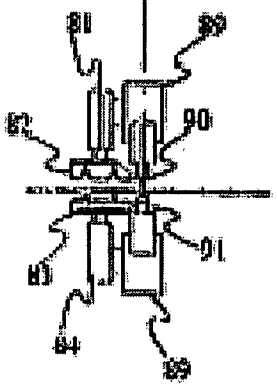

FIGS. 11A and 11B illustrate the layout of the first spot welding station (89) comprising an upper (90) and lower (91) welding head, the unit being preceded by upper (82) and lower (83) retaining jaws joined to an upper (81) and lower (84) retaining head respectively. These welding and retaining heads are moved simultaneously and the upper (90, 81) and lower (91, 84) heads are respectively joined to one another.

In order to obtain the most accurate retaining action possible, the upper retaining jaw (82) has hollow relief areas in which male relief areas on the lower jaw (83) mate, said relief areas having the shape of the meshes along the intersection points to be welded, at least to a certain extent.

This is illustrated by shading in FIG. 11B. This is the reason why the jaws (82, 83) can be removed and will depend on the design of the motifs in the lattice base (100).

The same operation is reproduced at the second welding station, illustrated in FIGS. 11C and 11D, which corresponds to the second transverse layout of intersection points of the lattice (100). It is also possible to apply horizontal welding by means of heads (93, 94), as illustrated in FIGS. 11G and 11H.

Operation on a level with the cutting bridge (97) is similar. Two respective upper (95) and lower (96) cutting heads are moved into contact with one another at the same time as upper (86) and lower (87) retaining heads connected to a retaining device (85) mounted on the cutting bridge (97).

As mentioned above, the chains (72) are of a limited extension, as far as the first welding bridge (89) in the case of the lateral chains and as far as the second welding bridge (92) in the case of the central chain. Slide plates (49), illustrated in FIGS. 12A to 12C, are provided at each end of the central chain (72) to facilitate feeding of the lattice at the outlet of said central chain (72). On a level with the drive motor (69), the latter is linked to the toothed wheel (71) via a reducing gear (68) and a linking shaft (67). Such slide plates (49) are also provided for the lateral chains (72), as illustrated in FIGS. 13A and 13B.

Figure 14A:
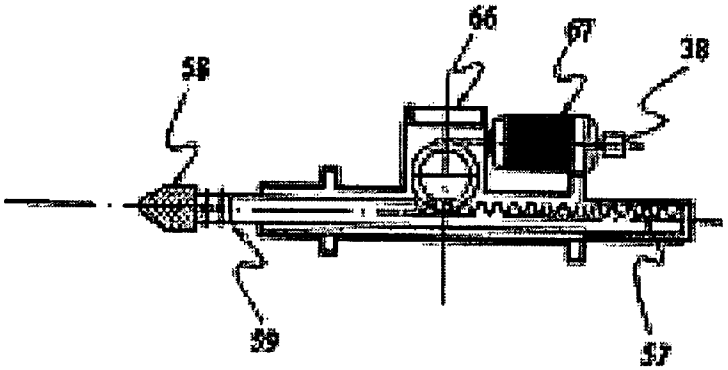
FIGS. 14A to 14D show a ram designed to apply the metal wire in an indentation of the shaping drum.
Figure 14B:
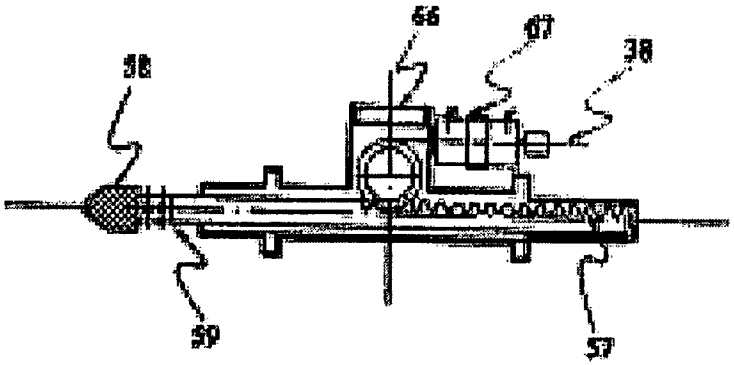
Figure 14C:
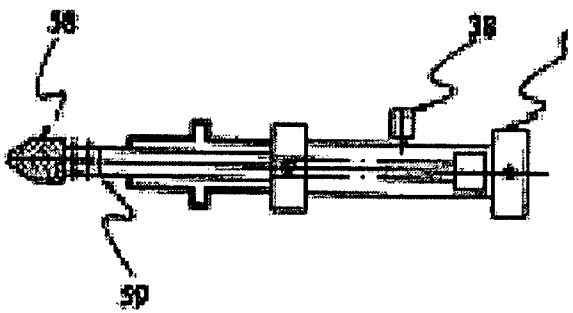
Figure 14D:
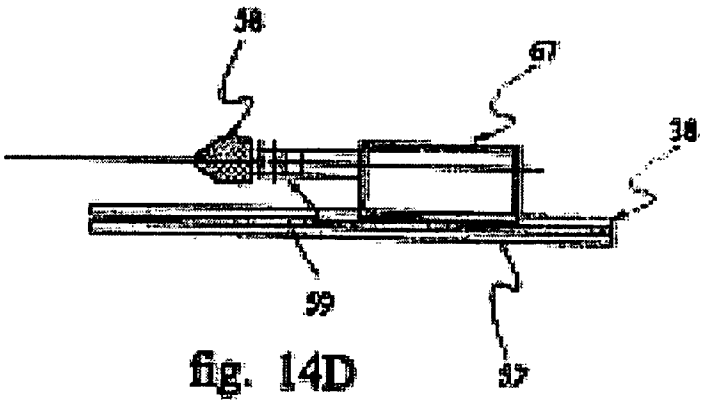
Figure 15A:
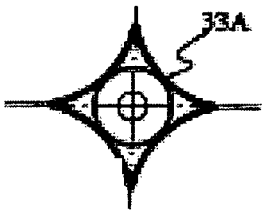
FIGS. 15A to 15H show, in section, two possible configurations of the shaping drum, with additional volumes modifying the initial configuration of the drum.
Figure 15B:
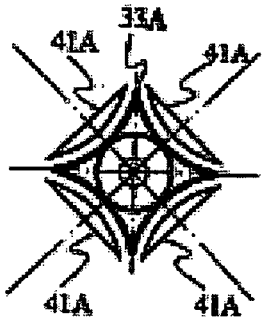
Figure 15C:
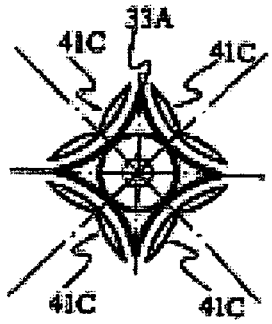
Figure 15D:
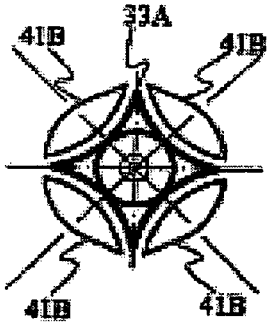
Figure 15E:
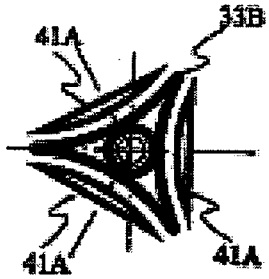
Figure 15F:
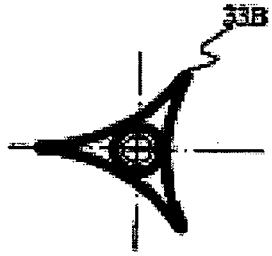
Figure 15G:
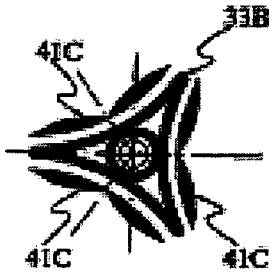
Figure 15H:
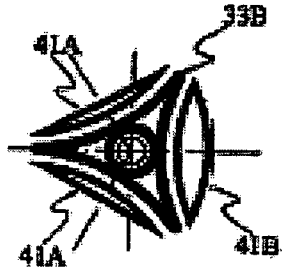
Figure 16A:
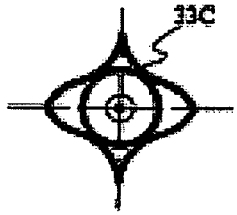
FIGS. 16A to 16H show other types of drum.
Figure 16B:
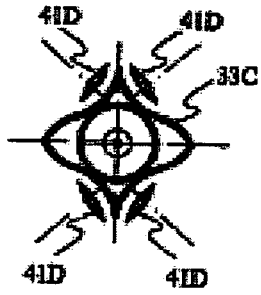
Figure 16C:
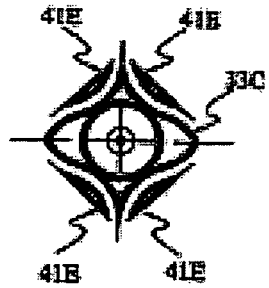
Figure 16D:
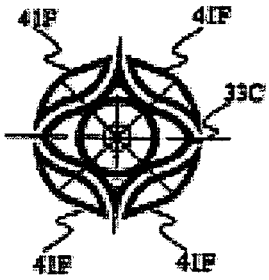
Figure 16E:
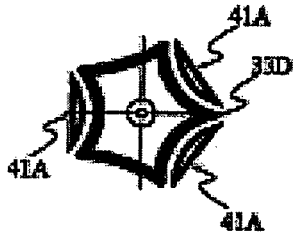
Figure 16F:
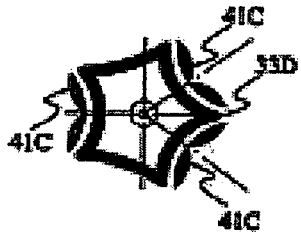
Figure 16G:
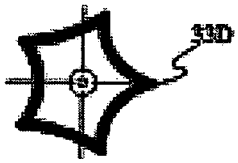
Figure 16H:
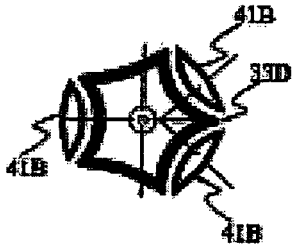

FIGS. 14A to 14D illustrate the design of a ram enabling the wire to be placed in indentations of the shaping drum (33). These rams have a head (58), the end of which has a design depending on said indentations, and said head (58) is therefore detachable. In the design illustrated in FIGS. 14A and 14B, these heads (58) are fixed by means of a tool holder (59) to a shaft (57) provided with a rack, said rack being driven in rectilinear displacement by a gear of a reducing gear (66) disposed at the output of the drive motor (67). The latter also has a displacement sensor (38), enabling the movement of the ram (58) to be synchronised on a programmable basis in the same way as the devices for positioning the wire in the concave surfaces, as explained above. FIGS. 14C and 14D show variants in which the head (58) is driven respectively by a piston (67) and by a linear motor (67).

FIGS. 15A to 15D illustrate a design of the drum (33A) in a star shape with four branches and four concave surfaces. These surfaces may be filled with additional volumes (41A to 41C) to produce different motifs in the base lattice using a same basic drum (33A). The same applies to the structure illustrated in FIGS. 15E to 15H, which is triangular (33B) in shape with three concave surfaces. It should be pointed out that in this case, additional filling volumes (41A to 41C) may also be used in different combinations.

FIGS. 16A to 16D illustrate another possible design of the base drum (33C) with additional volumes (41D to 41F) specifically adapted to this new design. The base drum (33D) illustrated in FIGS. 16E to 16H with five concave portions distributed in two groups with different arcs may be combined with the additional volumes (41A to 41C) illustrated in FIG. 15.

Figure 17A:
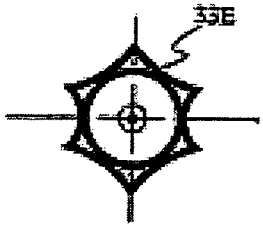
FIGS. 17A to 17H illustrate yet other types of drum.
Figure 17B:
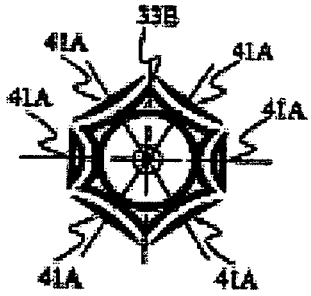
Figure 17C:
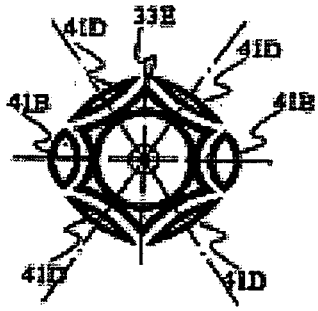
Figure 17D:
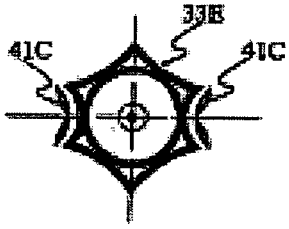
Figure 17E:
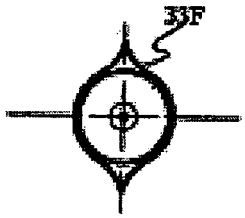
Figure 17F:
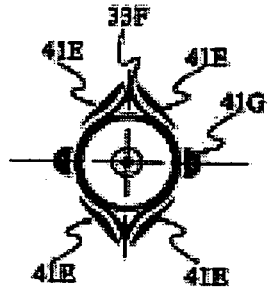
Figure 17G:
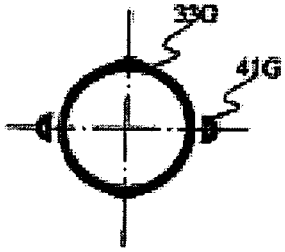
Figure 17H:
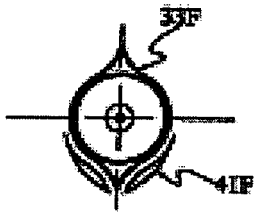

Variant (33E) illustrated in FIGS. 17A and 17B, with six concave portions also with two different arcs, also accommodates the additional volumes illustrated in FIG. 15. Conversely, the design of base drums (33F) uses additional volumes (41E to 41G), as yet not mentioned. The particular design (33G) illustrated in FIG. 17G, which is practically circular, simply uses two additional volumes (41G) in the shape of a half-moon.

Figure 18:
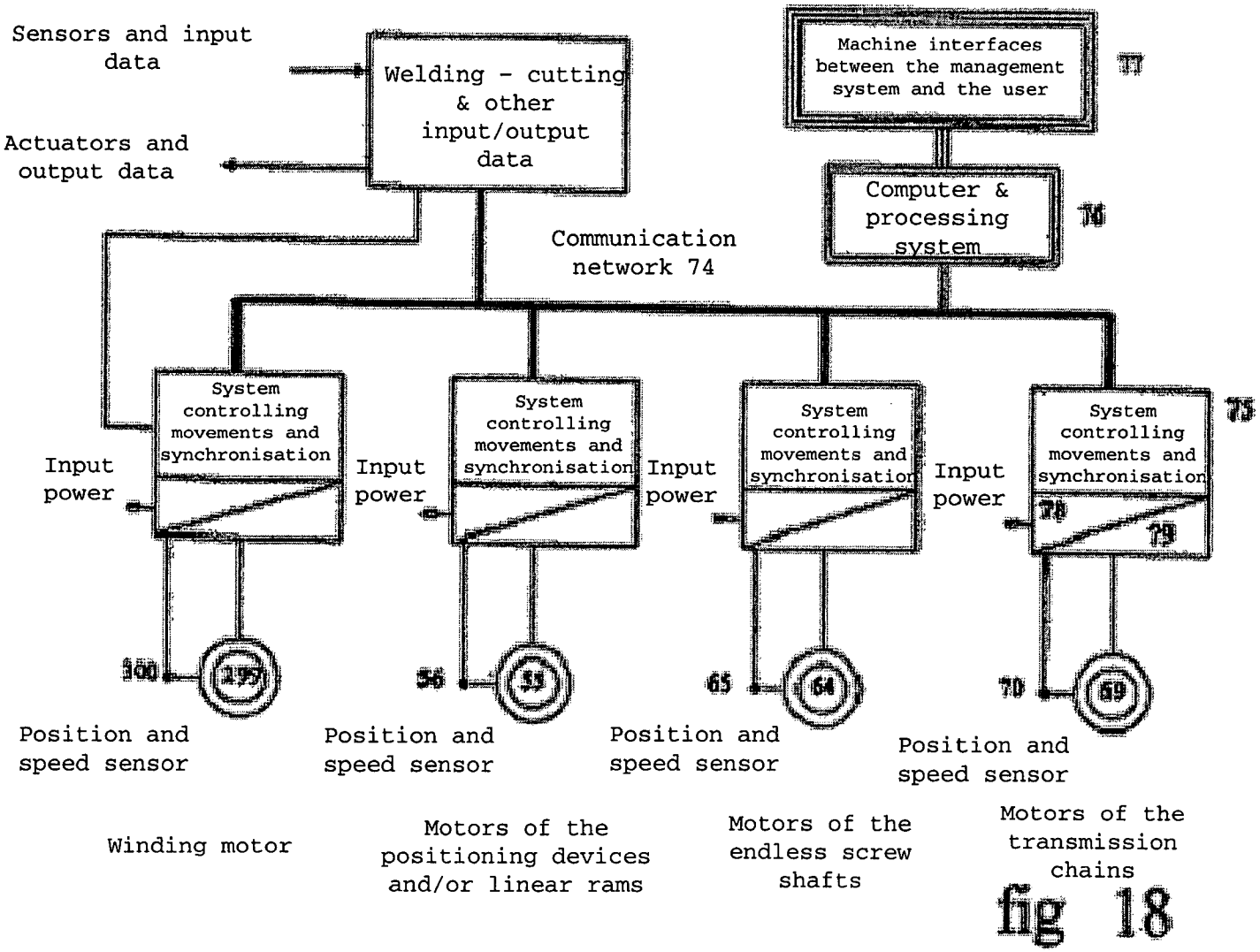
FIG. 18 is a synoptic diagram of the automatic control of the manufacturing process.

FIG. 18 provides a synoptic diagram explaining how the machine is managed on an automated basis, namely with the aid of a micro-computer (76) controlled by the user from a control interface (77) of a processing programming which sends and receives signals with the aid of a communication network (74) which controls:

- the winding motor (299) and receives signals via the sensor (300);
- the drive motors (55) of the devices for positioning the wire in the concave portions, and receives information from the sensors (56) co-operating with these motors;
- the motors (64) controlling the endless screws depositing the turns on the chains (72) and receiving information from the sensors (65) co-operating with them; and
- the drive motors (69) of the chains (72), and receives signals from the sensors (70) co-operating with them.

An electronic card for controlling displacements and synchronisation of the system (75) enables the unit to be managed and in particular has a converter stage (78) for signals and a control system (79) for the signals emitted by the various sensors disposed on the motors.

FIGS. 19-A1 to 19-N1 illustrate numerous designs of base drums, to which additional volumes may be added, as is the case. In all cases, if the design incorporating additional volumes requires the use of devices for positioning the wire, either in the concave portions or in the indentations, these devices are illustrated with the operating offset they assume due to the winding speed of the wire. In parallel, for each drawing, the resultant lattice (100) is illustrated.

Without going into detail in respect of each drawing, it should be pointed out that, taking FIG. 19-A1 as an example, the base drum (33A) is combined with two additional volumes (41B) forming a convex surface on two of the sides, which does not require an additional positioning device. The two remaining concave surfaces, on the other hand, require the actuation of positioning devices (50). These devices (50) are actuated one after the other, with a phase shift which depends on the rotation speed of the drive motor of the winder device, and controlled by the above-mentioned electronic system.

The same applies to FIG. 19-A2, in which no additional volume (41B) is provided and which therefore requires four positioning devices tracing a phase quadrature.

In FIG. 19-B2, the two additional volumes (41C) incorporate a central indentation which necessitates the use of a ram (57). The two devices (50) for positioning the wire in a concave surface and the two rams (57) are synchronised in the same manner, in phase quadrature, taking account of the technical specifications of the motors (55, 67) actuating the rotating devices on the one hand and the devices in which the rotating movement is converted into a rectilinear displacement, on the other hand.

This latter issue does not arise with the system illustrated in FIG. 19-B3, in which the four rams (57) are actuated in phase quadrature.

In certain cases, as is the case with FIG. 19-C2, it may be necessary to use a set of four devices (50) which can be applied to the concave surfaces and ram devices (57), the heads (58) of which are adapted to the additional volume (41G). FIGS. 19-C5 and 19-C6 illustrate alternative approaches to manufacturing the lattice (100) illustrated in FIG. 19-C1, with two and four rams respectively, the heads of which fulfil the same function as the positioning devices. FIG. 19-C7, finally, illustrates another manufacturing option which requires neither rams nor positioning devices.

It should be noted that in the case of a concave surface, it is also possible to use a ram device (57) but with a head (58) of the type illustrated as an example in FIG. 19-D4, which conforms to said concave surface and effects the positioning by means of a radial thrust.

All these drawings illustrate the large number of variants which can be implemented using the machine proposed by the invention and the different devices which may be used in conjunction with it.

FIGS. 19-N1 to 19-N3 specifically illustrate three additional options in terms of manufacturing and/or processing lattices (100):

- in 19-N1, the shaping drum (33) is pivoted at an angle of X°;
- in 19-N2, to the right-hand side of the diagram of the lattice (100) as illustrated in section, the latter has been longitudinally shaped in the vicinity of its borders; and
- in 19-N3, supplementary axial metal wires have been added (see section) along the borders on either side of the lattice.

Clearly, the invention as described as well as the examples of applications illustrated do not cover all the possible examples of ways in which the invention can be implemented, and it is not limited in by the description given above in any way. On the contrary, this invention encompasses all variants in terms of design, device and layout within the reach of the person skilled in the art.

The invention claimed is:

1. Machine for manufacturing a continuous strip of metal lattice by means of a single wire of flexible metal supplying said machine continuously, said lattice being produced by repeating a same motif of metal wire in a plane, each motif being superposed on the preceding motif with an offset of constant pitch in an axial direction in which the strip of lattice is produced, the machine comprising:

a stage at which the metal wire is stored;

a stage at which the machine is continuously supplied with metal wire;

a shaping stage at which said wire is configured in a succession of identical motifs;

a transfer stage for displacing each motif of metal wire successively towards the plane at which the strip of lattice is formed;

a stage at which each motif is retained in the plane and offset at a constant pitch before the subsequent motif arrives;

a stage at which the motifs are affixed to one another, wherein, the shaping stage comprises a shaping drum, retained in a fixed arrangement during the shaping process, around which the metal wire is wound, the shaping stage is pivotable relative to a shaping axis, and the machine further comprising:

means for constraining the wire so that the wire conforms to a shape of said shaping drum, the means being provided at a periphery of the shaping drum, and the movement of said means being synchronised with a winding movement of the wire.

2. Machine for manufacturing a continuous strip of lattice as claimed in claim 1, further comprising a device for cutting the strip of lattice disposed downstream of the means for affixing the motifs to one another.

3. Machine for manufacturing a continuous strip of lattice as claimed in claim 1, wherein the stage at which the flexible metal wire is stored consists of a reel of wire freely rotating in a support of said reel.

4. Machine for manufacturing a continuous strip of lattice as claimed in claim 1, wherein the stage for supplying the machine with metal wire comprises, in succession:

means for straightening the wire, designed to place the wire in a straight line, at least one pulley for guiding the wire towards a rotary device for winding around a drum.

5. Machine for manufacturing a continuous strip of lattice as claimed in claim 1, wherein the stage at which each motif of the lattice is transferred consists of an unreeling drum, coaxial with the shaping drum, equipped with helical worms, and actuated by a rotating movement synchronised with a winding speed of the wire, which enables the turns forming the motifs of the lattice to be separated.

6. Machine for manufacturing a continuous strip of lattice as claimed in claim 5, wherein devices enabling each turn to be deposited on the shaping plane of the lattice are disposed on a periphery of the unreeling drum, on a level with its end remote from the shaping drum, and the movement of these devices is synchronised with that of said unreeling drum.

7. Machine for manufacturing a continuous strip of lattice as claimed in claim 1, wherein the stage for retaining each motif in the shaping plane of the lattice and for offsetting it at a constant pitch before the subsequent motif arrives in said plane consists of a plurality of endless belts disposed parallel, driven at the same speed, which is synchronised with the speed at which the motifs of metal wire are shaped, and said belts have teeth at regular intervals enabling each motive deposited on the plane which they form to be driven.

8. Machine for manufacturing a continuous strip of lattice as claimed in claim 1, wherein the means for affixing the motifs of metal wire to one another comprise at least one welding bridge disposed transversely to the axis along which the lattice is fed.

9. Machine for manufacturing a continuous strip of lattice as claimed in claim 8, wherein at least one welding bridge applies a weld in a vertical direction and is preceded by a device which enables motifs sharing a same cross-section to be retained in contact with one another.

10. Machine for manufacturing a continuous strip of lattice as claimed in claim 8, wherein at least one welding bridge applies a weld in a horizontal direction.

11. Machine for manufacturing a continuous strip of lattice as claimed in claim 4, wherein the winding device comprises a hollow rotating shaft through which the wire passes after being guided by means of at least one pulley orienting said wire towards said shaft, the outlet of which is equipped with a pulley reorienting the wire in a radial direction towards an external winding pulley, the axis of which subtends an acute angle with the axis of rotation of the winding device, the circular displacement of which has a bigger radius than that of the winding drum.

12. Machine for manufacturing a continuous strip of lattice as claimed in claim 11, wherein said winding device is driven by an electric motor.

13. Machine for manufacturing a continuous strip of lattice as claimed in claim 11, wherein the shaping drum is disposed coaxially with the winding device, in the extension of the hollow shaft.

14. Machine for manufacturing a continuous strip of lattice as claimed in claim 1, wherein radial spring-biased rams hold the wire wound around the shaping drum.

15. Machine for manufacturing a continuous strip of lattice as claimed in claim 1, wherein the drum has at least one indented and/or concave surface, a corresponding number of devices designed to apply the wire against said surface or surfaces is provided at the periphery of said drum, and the movement of this or these devices(s) is synchronised with the speed transmitted by the winding motor.

16. Machine for manufacturing a continuous strip of lattice as claimed in claim 15, wherein the device designed to apply the wire against a concave surface causes the wire to assume the shape of an indented arc comprises a rotating element with an axis of rotation parallel with the axis of the drum, equipped with a wing perpendicular to said axis, the external edge of the wing is provided with means for guiding the metal wire, and has the contour of a section conforming to the shape of the concave surface.

17. Machine for manufacturing a continuous strip of lattice as claimed in claim 16, wherein said wing comprises two sections, a first section with an elliptical external edge provided with at least one guide roller for the metal wire, and a second section with a contour continuing from the first forming an arc of a circle and having a lateral edge parallel with the axis of rotation, provided with a guide groove, and the element for positioning the wire is rotated so that the elliptical section penetrates the concave shape of the drum first.

18. Machine for manufacturing a continuous strip of lattice as claimed in claim 17, wherein the guide rollers with an elliptical section are provided in a plurality distributed across its edge, and a roller with a bigger diameter is fitted on the end of said section penetrating the concave shape first.

19. Machine for manufacturing a continuous strip of lattice as claimed in claim 15, wherein the device designed to apply the wire in an indentation of the wall of the drum comprises a ram, a detachable head of the ram has a shape which can be inserted in said indentation, said head being mobile in translation, and the displacement is programmed so that it is synchronised with the winding speed.

20. Machine for manufacturing a continuous strip of lattice as claimed in claim 19, wherein the ram is controlled by a motor actuating a rack via a gear mounted on a shaft, at the end of the shaft the head is affixed.

21. Machine for manufacturing a continuous strip of lattice as claimed in claim 19, wherein the ram is actuated by a piston or a linear motor.

22. Machine for manufacturing a continuous strip of lattice as claimed in claim 5, wherein at least one guide device for axially fixing the turns forming the motifs of the lattice is placed along and in the extension of the unreeling drum, said guiding action being afforded by means of at least one internal guide disposed facing an external guide, each pair of guides bounding a passage conforming to the shape of each turn and disposed as a function of worms of the unreeling drum, in at least one point where the motif has a projection towards the exterior.

23. Machine for manufacturing a continuous strip of lattice as claimed in claim 6, wherein the devices enabling each turn to be deposited on the shaping plane of the lattice comprises endless screw shafts disposed at regular intervals at the periphery and in the axial extension of the unreeling drum, said shafts being driven by electric motors synchronised so that they are actuated individually or in groups, namely in succession, and enable one turn forming a motif of the lattice to be extracted after the other.

24. Machine for manufacturing a continuous strip of lattice as claimed in claim 7, wherein the shaping plane of the lattice obtained by successively offsetting the motifs comprises a central chain and two lateral chains, equipped with teeth for driving the motifs, said chains being driven by motors synchronised with each other and with the motors of the endless screw devices.

25. Machine for manufacturing a continuous strip of lattice as claimed in claim 24, wherein said chains have a guide strip and a fixed rigid guard mounted above them.

26. Machine for manufacturing a continuous strip of lattice as claimed in claim 24, wherein slide plates are disposed underneath the lattice at the ends of the chains, which are distal with respect to the system of manufacturing the motifs of said lattice.

27. Machine for manufacturing a continuous strip of lattice as claimed in claim 8, wherein there are two transverse welding bridges operating in a vertical direction, each preceded by a bridge for retaining the motifs forming the lattice, each bridge being equipped with two heads disposed on either side of the lattice, each applying an action in the direction of the other head.

28. Machine for manufacturing a continuous strip of lattice as claimed in claim 27, wherein said heads of the retaining bridges are detachable and have male and female relief areas respectively which depend on the motifs forming the lattice and enable an inter-penetration in order to place said motifs in contact with one another in readiness for welding.

29. Machine for manufacturing a continuous strip of lattice as claimed in claim 27, wherein the welding bridges apply a spot weld to at least some of the intersections of the motifs in a transverse direction, two times, corresponding to two transverse patterns of intersection of the motifs forming the lattice.

30. Machine for manufacturing a continuous strip of lattice as claimed in claim 8, further comprising a welding bridge operating in a horizontal direction by means of at least a pair of extractable heads which can be inserted in the two successive meshes of the lattice in the direction in which the latter is fed.

31. Machine for manufacturing a continuous strip of lattice as claimed in claim 24, wherein the lateral chains extend as far as a first welding bridge, whereas the central chain extends as far as a second welding bridge.

32. Machine for manufacturing a continuous strip of lattice as claimed claim 1, wherein the shaping drum has a main body, to which at least one additional volume designed to modify a portion of its external shaping wall can be fixed.

33. Machine for manufacturing a continuous strip of lattice as claimed in claim 32, wherein the additional volume is configured so that the additional volume is inserted in at least a portion of concave surface of the wall of the drum in order to define a new portion of flat or convex wall.

34. Machine for manufacturing a continuous strip of lattice as claimed in claim 32, wherein the additional volume is configured so that the additional volume is inserted in at least one portion of concave surface of the wall of the drum in order to define a new portion of wall incorporating an indentation.

35. Machine for manufacturing a continuous strip of lattice as claimed in claim 7, further comprising at least one reel of wire disposed to the side of the shaping plane of the lattice, the wire being directed towards a face of the strip of lattice and re-oriented during feeding so as to be parallel with said feed direction, then fixed to the strip of lattice.

36. Machine for manufacturing a continuous strip of lattice as claimed in claim 35, wherein the reels are two or four in number, in which case the wires are directed respectively to one or the two faces of the strip of lattice.

37. Machine for manufacturing a continuous strip of lattice as claimed in claim 1, further comprising a stage for axially shaping at least a transverse portion of the strip of lattice on a continuous basis.

38. Machine for manufacturing a continuous strip of lattice as claimed in claim 37, wherein the shaping is effected along two transverse portions alongside borders of the strip of lattice.

39. Machine for manufacturing a continuous strip of lattice as claimed in claim 1, further comprising a central electronic unit for managing the machine, the parameters of which can be controlled by means of peripheral devices accessible to the user, and said central electronic unit processes the signals emitted by sensors indicating an instantaneous state of certain moving components of the machine.

40. Machine for manufacturing a continuous strip of lattice as claimed in claim 39, wherein said peripheral devices accessible to the user comprise a monitor and a keyboard.

41. Machine for manufacturing a continuous strip of lattice as claimed in claim 39, wherein said central electronic unit and peripheral devices form part of a micro-computer containing a program for managing the machine.

42. Machine for manufacturing a continuous strip of lattice as claimed in claim 39, wherein the sensors are applied to various motors of the machine and provide information about a position of the motors and a speed of the motors at any instant.

43. Strip of lattice manufactured with the aid of a machine as claimed in claim 42, wherein the strip of lattice is made by repeating a single motif offset along the axis in which said strip is produced and said motifs are welded to one another on a level with at least some of their intersections.

44. Strip of lattice as claimed in claim 43, wherein the strip of lattice has at least one wire on at least one of its faces, which is axially affixed thereto on a continuous basis.

45. Strip of lattice as claimed in claim 43, wherein the strip of lattice has a continuous axial shaping on at least one transverse portion.

46. Method of manufacturing a strip of lattice on a continuous basis by means of a single metal wire, comprising the following steps:

winding the metal wire around a shaping drum so that each turn then constitutes an identical motif;

separating the turns in a direction of an axis of the shaping drum;

depositing the turns on a shaping plane of the lattice oriented perpendicular to said axis of the shaping drum;

continuously displacing said plane, in synchronisation with the speeds at which the turns are wound, separated and deposited in order to create an offset between the turns and form the succession of said repetitive patterns of the lattice; and welding at least some of the intersection points of said motifs constituting the lattice, wherein an external wall of the shaping drum has at least one concave portion and/or at least one indentation and the process of shaping by winding around the shaping drum is effected by means of a corresponding number of devices designed to apply the wire against said portion of the external wall.

47. Method of manufacturing a strip of lattice on a continuous basis as claimed in claim 46, wherein, prior to the winding step in readiness for shaping, the wire is continuously unreeled from a storage reel.

48. Method of manufacturing a strip of lattice on a continuous basis as claimed in claim 46, wherein the welding step is followed by a step of cutting the strip of lattice to a desired length.

49. Method of manufacturing a strip of lattice on a continuous basis as claimed in claim 46, wherein the running of the various steps is automated with the aid of an electronic central unit or a micro-processor equipped with peripheral devices enabling it to be controlled by the user and responding to sensors tracking the progress of the different steps implemented during the course of the method.

50. Method of manufacturing a strip of lattice on a continuous basis as claimed in claim 49, wherein the sensors co-operate with electric motors, making it possible to ascertain a speed of the electric motors and a position of the electric motors at any instant.

51. Method of manufacturing a strip of lattice on a continuous basis as claimed in claim 46, wherein at least one metal wire is axially affixed to one of the faces of the strip of lattice on a continuous basis.

52. Method of manufacturing a strip of lattice on a continuous basis as claimed in claim 51, wherein two or four wires are affixed extending alongside borders on one or two faces of the strip of lattice.

53. Method of manufacturing a strip of lattice on a continuous basis as claimed in claim 46, wherein at least one transverse portion of the strip of lattice is axially shaped on a continuous basis after the motifs have been welded to one another.

* * * * *